US010535921B2

(12) United States Patent
Hu

(10) Patent No.: US 10,535,921 B2
(45) Date of Patent: Jan. 14, 2020

(54) RECONFIGURABLE MULTI-BAND ANTENNA WITH FOUR TO TEN PORTS

(71) Applicant: Smart Antenna Technologies Ltd., Birmingham (GB)

(72) Inventor: Sampson Hu, Birmingham (GB)

(73) Assignee: Smart Antenna Technologies Ltd., Birmingham (GB)

( * ) Notice: Subject to any disclaimer, the term of this patent is extended or adjusted under 35 U.S.C. 154(b) by 212 days.

(21) Appl. No.: 15/508,781

(22) PCT Filed: Sep. 4, 2015

(86) PCT No.: PCT/GB2015/052571
§ 371 (c)(1),
(2) Date: Mar. 3, 2017

(87) PCT Pub. No.: WO2016/034900
PCT Pub. Date: Mar. 10, 2016

(65) Prior Publication Data

US 2017/0256854 A1 Sep. 7, 2017

(30) Foreign Application Priority Data

Sep. 5, 2014 (GB) ..... 1415782.0
Sep. 5, 2014 (GB) ..... 1415785.3

(51) Int. Cl.
*H01Q 21/28* (2006.01)
*H01Q 1/52* (2006.01)
(Continued)

(52) U.S. Cl.
CPC ..... *H01Q 1/523* (2013.01); *H01Q 1/243* (2013.01); *H01Q 1/48* (2013.01); *H01Q 5/335* (2015.01);
(Continued)

(58) Field of Classification Search
CPC ..... H01Q 1/523; H01Q 5/335; H01Q 1/243; H01Q 1/48; H01Q 9/20; H01Q 9/40;
(Continued)

(56) References Cited

U.S. PATENT DOCUMENTS 6,362,793 B1 * 3/2002 Sawamura ..... H01Q 1/243 343/702
6,426,723 B1 7/2002 Smith et al.
(Continued)

FOREIGN PATENT DOCUMENTS

EP 1154513 A1 11/2001
EP 1772930 A1 4/2007
(Continued)

OTHER PUBLICATIONS

Communication to pursuant to Article 94(3) EPC from counterpart EP 15762691.2, dated May 2, 2018, 6 pp.
(Continued)

*Primary Examiner* — Hai V Tran
*Assistant Examiner* — Bamidele A Jegede
(74) *Attorney, Agent, or Firm* — Shumaker & Sieffert, P.A.

(57) ABSTRACT

There is disclosed a reconfigurable antenna device having a substrate incorporating a first groundplane, a two-arm antenna having first and second arms each having a proximal portion and a distal portion, a first unbalanced antenna located generally between the distal portions and adjacent to the proximal portions of the first and second arms, a second unbalanced antenna located generally adjacent to the first arm and a third unbalanced antenna located generally adjacent to the second arm. The antenna device may be configured with four or five feed points, and may drive from four up to ten signal ports.

36 Claims, 26 Drawing Sheets

(51) Int. Cl.

| | |
|---|---|
| ***H01Q 1/24*** | (2006.01) |
| ***H01Q 9/20*** | (2006.01) |
| ***H01Q 9/40*** | (2006.01) |
| ***H01Q 5/335*** | (2015.01) |
| ***H01Q 1/48*** | (2006.01) |
| ***H01Q 21/22*** | (2006.01) |
| *H01Q 9/16* | (2006.01) |
| *H01Q 9/30* | (2006.01) |
| *H01Q 1/22* | (2006.01) |

(52) U.S. Cl.
CPC ..... *H01Q 9/20* (2013.01); *H01Q 9/40* (2013.01); *H01Q 21/22* (2013.01); *H01Q 21/28* (2013.01); *H01Q 1/2266* (2013.01); *H01Q 9/16* (2013.01); *H01Q 9/30* (2013.01)

(58) Field of Classification Search
CPC ..... H01Q 21/22; H01Q 21/28; H01Q 1/2266; H01Q 9/16; H01Q 9/30
See application file for complete search history.

(56) References Cited

U.S. PATENT DOCUMENTS

| | | | | |
|---|---|---|---|---|
| 6,433,749 | B1 | 8/2002 | Thompson | |
| 8,648,756 | B1 | 2/2014 | Desclos et al. | |
| 9,241,050 | B1 | 1/2016 | Asrani et al. | |
| 2003/0189519 | A1 | 10/2003 | Rutfors et al. | |
| 2004/0032706 | A1 | 2/2004 | Kemmochi et al. | |
| 2004/0075614 | A1 | 4/2004 | Dakeya et al. | |
| 2005/0012675 | A1 | 1/2005 | Sakiyama et al. | |
| 2005/0093645 | A1 | 5/2005 | Watanabe et al. | |
| 2007/0001911 | A1 | 1/2007 | Fujio et al. | |
| 2007/0024513 | A1* | 2/2007 | Sako | H01Q 9/36 343/727 |
| 2007/0057854 | A1 | 3/2007 | Oodachi et al. | |
| 2007/0190954 | A1 | 8/2007 | Murakami et al. | |
| 2007/0241985 | A1 | 10/2007 | Suzuki et al. | |
| 2007/0268191 | A1* | 11/2007 | Ishizuka | H01Q 1/243 343/702 |
| 2007/0279287 | A1 | 12/2007 | Castaneda et al. | |
| 2007/0291831 | A1 | 12/2007 | Lee et al. | |
| 2008/0062335 | A1 | 3/2008 | Ho | |
| 2008/0079640 | A1 | 4/2008 | Yang | |
| 2008/0106476 | A1 | 5/2008 | Tran et al. | |
| 2008/0111746 | A1 | 5/2008 | Levy et al. | |
| 2008/0204163 | A1 | 8/2008 | Royak et al. | |
| 2008/0238789 | A1 | 10/2008 | Wilcox | |
| 2008/0316116 | A1 | 12/2008 | Hobson et al. | |
| 2009/0102742 | A1 | 4/2009 | Park et al. | |
| 2009/0115673 | A1* | 5/2009 | Nysen | H01Q 1/2275 343/730 |
| 2009/0207092 | A1* | 8/2009 | Nysen | H01Q 1/2275 343/876 |
| 2009/0231200 | A1* | 9/2009 | Chiu | H01Q 1/243 343/700 MS |
| 2009/0273521 | A1 | 11/2009 | Wong et al. | |
| 2009/0273531 | A1* | 11/2009 | Ishizuka | H01Q 1/243 343/750 |
| 2010/0045540 | A1 | 2/2010 | Lai et al. | |
| 2010/0073247 | A1 | 3/2010 | Arkko et al. | |
| 2010/0090917 | A1 | 4/2010 | Roeckl et al. | |
| 2010/0220022 | A1* | 9/2010 | Yoon | H01Q 1/243 343/727 |
| 2010/0321130 | A1 | 12/2010 | Kim et al. | |
| 2011/0287731 | A1* | 11/2011 | Hase | H01Q 9/16 455/269 |
| 2013/0002501 | A1 | 1/2013 | Li et al. | |
| 2013/0076579 | A1 | 3/2013 | Zhang et al. | |
| 2013/0076580 | A1* | 3/2013 | Zhang | H01Q 1/243 343/720 |
| 2013/0076587 | A1* | 3/2013 | Wong | H01Q 1/243 343/848 |
| 2013/0203364 | A1 | 8/2013 | Darnell et al. | |
| 2013/0307742 | A1 | 11/2013 | Hu et al. | |
| 2013/0314297 | A1 | 11/2013 | Hamabe | |
| 2014/0011460 | A1* | 1/2014 | Ali | H01Q 1/243 455/75 |
| 2014/0028525 | A1 | 1/2014 | Ying | |
| 2014/0055209 | A1 | 2/2014 | Ishizuka et al. | |
| 2014/0085160 | A1 | 3/2014 | Valkonen et al. | |
| 2014/0106684 | A1 | 4/2014 | Burns et al. | |
| 2014/0159971 | A1* | 6/2014 | Hall | H01Q 1/243 343/745 |
| 2015/0194738 | A1 | 7/2015 | Hu et al. | |
| 2016/0087328 | A1 | 3/2016 | Lee et al. | |

FOREIGN PATENT DOCUMENTS

| | | | |
|---|---|---|---|
| EP | 2091103 | A1 | 8/2009 |
| EP | 2518824 | A1 | 10/2012 |
| EP | 2683027 | A1 | 1/2014 |
| GB | 2507788 | A | 5/2014 |
| JP | 2007221344 | A | 8/2007 |
| JP | 2012209712 | A | 10/2012 |
| JP | 2014086949 | A | 5/2014 |
| WO | 2013014458 | A1 | 1/2013 |
| WO | 2014020302 | A1 | 2/2014 |

OTHER PUBLICATIONS

Response to European Examiner Report dated May 2, 2018, from counterpart European Patent Application No. 15762691.2, filed on Sep. 10, 2018, 54 pp.
Combined Search and Examination Report for corresponding GB Application No. 1415782.0, dated Mar. 2, 2015 (9 pgs.).
Combined Search and Examination Report for corresponding GB Application No. 1415785.3, dated Mar. 26, 2015 (8 pgs.).
International Search Report and Written Opinion for corresponding PCT Application No. PCT/GB2015/052571, dated Nov. 25, 2015 (21 pgs.).

* cited by examiner

RECONFIGURABLE MULTI-BAND ANTENNA WITH FOUR TO TEN PORTS

This application is a national stage application under 35 U.S.C. § 371 of PCT Application No. PCT/GB2015/052571, filed Sep. 4, 2015, which claims the benefit of Great Britain Application No. 1415782.0, filed Sep. 5, 2014 and Great Britain Application No. 1415785.3, filed Sep. 5, 2014. The entire contents of each of PCT Application No. PCT/GB2015/052571, Great Britain Application No. 1415782.0 and Great Britain Application No. 1415785.3 are incorporated herein by reference in their entirety.

This invention relates to a reconfigurable antenna. Particularly, but not exclusively, the invention relates to a reconfigurable multiple-input multiple-output (MIMO) antenna for use in a portable electronic device such as a mobile phone handset, laptop, tablet, femtocell, wireless router or other radio communications device.

BACKGROUND

Multiple-input multiple-output (MIMO) wireless systems exploiting multiple antennas as both transmitters and receivers have attracted increasing interest due to their potential for increased capacity in rich multipath environments. Such systems can be used to enable enhanced communication performance (i.e. improved signal quality and reliability) by use of multi-path propagation without additional spectrum requirements. This has been a well-known and well-used solution to achieve high data rate communications in relation to 2G and 3G communication standards. For indoor wireless applications such as router devices, external dipole and monopole antennas are widely used. In this instance, high-gain, omni-directional dipole arrays and collinear antennas are most popular. However, very few portable devices with MIMO capability are available in the marketplace. The main reason for this is that, when gathering several radiators in a portable device, the small allocated space for the antenna limits the ability to provide adequate isolation between each radiator.

A reconfigurable MIMO antenna is known from WO 2012/072969 (the content of which is incorporated into the present disclosure by reference). An embodiment is described in which the antenna comprises a balanced antenna located at a first end of a PCB and a two-port chassis-antenna located at an opposite second end of the PCB. However, in certain applications this configuration may not be ideal or even practical since it requires two separate areas in which to locate each antenna. However, as mentioned above this spacing was chosen to provide adequate isolation between each antenna structure.

Another reconfigurable antenna is known from WO 2014/020302 (the content of which is incorporated into the present disclosure by reference). This antenna comprises a balanced antenna and an unbalanced antenna mounted on a supporting PCB substrate, with both the balanced antenna and the unbalanced antenna located at the same end of the substrate. The antenna may be configured as a chassis antenna for use in a portable device and may be configured for MIMO applications. In one embodiment of the antenna of WO 2014/020302, there is provided a floating groundplane connected to the balanced antenna. The floating groundplane is constituted by a rectangular metal patch located on a first surface of the substrate, centrally below feed lines provided on the first surface to feed the balanced and unbalanced antennas. A first matching circuit configured to excite the arms of the balanced antenna is located on the floating groundplane. The unbalanced antenna is mounted on a second surface of the substrate, opposed to the first surface, and is connected to a second matching circuit mounted on the PCB substrate. In another embodiment, the floating groundplane may be incorporated in one arm of the balanced antenna, thereby saving space on the PCB substrate. Each matching circuit is coupled to a signal port, and the antenna as disclosed therefore provides only two ports.

Certain handset and other portable device manufacturers, however, require an antenna with more than two ports. A particular problem with multi-port antennas, particularly when there more than just two ports, is how to obtain sufficient isolation between the ports.

BRIEF SUMMARY OF THE DISCLOSURE

Viewed from a first aspect, there is provided a reconfigurable antenna device comprising a substrate incorporating a first groundplane, a two-arm antenna having first and second arms each having a proximal portion and a distal portion, a first unbalanced antenna located generally between the distal portions and adjacent to the proximal portions of the first and second arms, a second unbalanced antenna located generally adjacent to the first arm and a third unbalanced antenna located generally adjacent to the second arm, wherein a region at one end of the substrate where the antennas are mounted is free of the first groundplane, the groundplane having an edge facing the end of the substrate where the antennas are mounted, wherein the respective antennas and the first groundplane are substantially coplanar or disposed in two or more substantially parallel planes, wherein each of the two-arm antenna and the first, second and third unbalanced antennas is provided with a respective matching circuit and at least one signal port, wherein the two-arm antenna and the first unbalanced antenna are provided with substantially centrally located feedlines, and wherein at least the first, second and third unbalanced antennas have feedpoints at a central portion of said edge of said first groundplane.

In the context of the present application, a "balanced antenna" is an antenna that has a pair of radiating arms extending in different, for example opposed or orthogonal, directions away from a central feed point. Examples of balanced antennas include dipole antennas and loop antennas. In a balanced antenna, the radiating arms are fed against each other, and not against a groundplane. In many balanced antennas, the two radiating arms are substantially symmetrical with respect to each other, although some balanced antennas may have one arm that is longer, wider or otherwise differently configured to the other arm. A balanced antenna is usually fed by way of a balanced feed.

In contrast, an "unbalanced antenna" is an antenna that is fed against a groundplane, which serves as a counterpoise. An unbalanced antenna may take the form of a monopole antenna fed at one end, or may be configured as a centre fed monopole or otherwise. An unbalanced antenna may be configured as a chassis antenna, in which the antenna generates currents in the chassis of the device to which the antenna is attached, typically a groundplane of the device. The currents generated in the chassis or groundplane give rise to radiation patterns that participate in the transmission/reception of RF signals. An unbalanced antenna is usually fed by way of an unbalanced feed.

A balun may be used to convert a balanced feed to an unbalanced feed and vice versa.

A reconfigurable antenna is an antenna capable of modifying dynamically its frequency and radiation properties in a controlled and reversible manner. In order to provide a dynamical response, reconfigurable antennas integrate an inner mechanism (such as RF switches, varactors, mechanical actuators or tuneable materials) that enable the intentional redistribution of the RF currents over the antenna surface and produce reversible modifications over its properties. Reconfigurable antennas differ from smart antennas because the reconfiguration mechanism lies inside the antenna rather than in an external beamforming network. The reconfiguration capability of reconfigurable antennas is used to maximize the antenna performance in a changing scenario or to satisfy changing operating requirements.

The term "adjacent to" is intended to mean "next to" or "alongside".

One advantage of feeding all of the antennas from a central portion of the edge of the groundplane is that good isolation between the antennas may be obtained. A further advantage of feeding the various antennas from a central portion of the edge of the groundplane is that all of the matching circuits and signal ports can be incorporated into a single chip located at the central portion of the edge of the groundplane in certain embodiments. This saves valuable real estate on the substrate.

The substrate may comprise a printed circuit board substrate, and the first conductive groundplane may be a conductive layer on one surface of the substrate or disposed between upper and lower surfaces of the substrate.

In preferred embodiments, a region at one end of the substrate where the various antennas are mounted is free of the first groundplane, the groundplane having an edge facing the end of the substrate where the antennas are mounted.

The first unbalanced antenna may be coplanar with the second and third unbalanced antennas, or may be disposed in a substantially parallel plane.

The first and second radiating arms of the two-arm antenna may comprise a pair of generally L-shaped members, which may be disposed generally in the plane of the substrate. The L-shaped members may be disposed in a substantially mirror-symmetrical arrangement about a longitudinal axis of the substrate. Although in some embodiments, the first and second arms are of substantially the same dimensions (i.e. exhibit true mirror symmetry about the axis), other embodiments may comprise first and second arms of differing dimensions.

The two-arm antenna is provided with a feed that is connected to matching circuitry. Where appropriate, the feed may incorporate a balun.

In one embodiment, the two-arm antenna is configured as a balanced antenna, which may be fed with a balanced feed between the first and second arms, where necessary by way of a balun. The two-arm antenna then acts as a dipole, and does not need to be driven against a groundplane.

Alternatively, the second arm of the two-arm antenna may comprise or be provided with a second groundplane. In this embodiment, the first arm of the two-arm antenna acts as a monopole driven against the second arm, which serves as a groundplane, and no balun is required for feeding an unbalanced signal to the first radiating arm. Matching circuitry for the two-arm antenna may be disposed on the second arm, thus freeing up valuable real estate on the main substrate. The configuration of the two arms of the two-arm antenna helps to improve isolation from the other antennas.

Alternatively, the two-arm antenna may be connected to a second groundplane (or floating groundplane) configured as a conductive patch located on the substrate but separated from the first groundplane. For example, the second groundplane may be disposed on an opposed surface of the substrate to that on which the first groundplane is disposed. Matching circuitry for the two-arm antenna may be disposed on the second groundplane or floating groundplane.

The first unbalanced antenna is located between the distal portions of the two-arm antenna, generally adjacent to the proximal portions. The first unbalanced antenna may comprise an elongate conductive strip as a radiating element, having a length that is preferably substantially parallel to the proximal portions. A first half of the conductive strip of the first unbalanced antenna is located generally adjacent and parallel to the proximal portion of the first arm of the two-arm antenna, with a second half being located generally adjacent and parallel to the proximal portion of the second arm. The first unbalanced antenna may be located in the same plane as the two-arm antenna, for example on the same surface of the substrate, or may be in a parallel plane, for example on an opposed surface of the substrate. The first unbalanced antenna may further comprise a central stub that extends towards but does not contact the first groundplane. The stub may provide a connection point for a feed to the first unbalanced antenna.

The second unbalanced antenna may also comprise a conductive strip as a radiating element, and may be located adjacent to and substantially parallel to the first half of the first unbalanced antenna, and thus also generally adjacent to the first arm of the two-arm antenna. The second unbalanced antenna may be located between the distal portion of the first arm of the two-arm antenna and the central stub of the first unbalanced antenna.

The third unbalanced antenna may also comprise a conductive strip as a radiating element, and may be located adjacent to and substantially parallel to the second half of the first unbalanced antenna, and thus also generally adjacent to the second arm of the two-arm antenna. The third unbalanced antenna may be located between the distal portion of the second arm of the two-arm antenna and the central stub of the first unbalanced antenna.

The second and/or the third unbalanced antennas may be mounted on the substrate in the same plane as the two-arm antenna, or in a different plane (for example on an opposed surface of the substrate, or sandwiched between opposed surfaces of the substrate). The second and third unbalanced antennas need not be mounted in the same plane. In some embodiments, the second and third unbalanced antennas have substantially the same dimensions, and may be disposed substantially symmetrically about the longitudinal axis of the substrate. Alternatively, the second and third unbalanced antennas have different dimensions.

In certain embodiments, the second and third unbalanced antennas are located between the first unbalanced antenna and the edge of the first conductive groundplane facing the end of the substrate where the antennas are mounted.

Alternatively, the second and third unbalanced antennas may be located between the first unbalanced antenna and, respectively, the proximal portions of the first and second arms of the two-arm antenna.

The first, second and third unbalanced antennas may be connected to and driven against the first groundplane. Each of the first, second and third antennas is provided with a respective feed and respective matching circuitry.

The second and third unbalanced antennas may be driven together as a balanced pair with appropriate matching circuitry.

Preferred embodiments thus provide a reconfigurable antenna which can be located at one end of a supporting substrate (e.g. a PCB) and which is therefore easily integrated into small portable devices such as mobile phone handsets and tablets. The antenna device may have a small, low profile and be relatively cheap to manufacture. Embodiments may offer good performance (high efficiency and gain), reduced specific absorption rate (SAR), a wide bandwidth or range of bandwidths and high isolation between each radiator.

Matching circuitry may be provided for each antenna element to tune the respective element to a desired operating frequency or band. For example, the antenna device may be configured to cover one or more of: DVB-H, GSM710, GSM850, GSM900, GSM1800, PCS1900, GPS1575, UMTS2100, WiFi (e.g. 2.4 GHz and 5 GHz), Bluetooth®, LTE, LTA and 4G frequency bands.

The antenna elements may be formed as etched or metallised tracks on the substrate, or may be formed as metal plates that are adhered or otherwise attached to the substrate.

Multiple matching circuits may be provided for the various antenna elements, and different modes of operation may be selected by switching between the various matching circuits.

Each matching circuit may comprise at least one variable capacitor to tune the frequency of its associated antenna element over a desired frequency range. The variable capacitor may be constituted by multiple fixed capacitors with switches, or by varactors or MEMs capacitors. In addition, one or more of the matching circuits may further be provided with at least one inductor, which may be fixed or variable.

The two-arm antenna and its associated matching circuitry may be coupled to a first signal port.

The first unbalanced antenna and its associated matching circuitry may be coupled to a second signal port.

The second unbalanced antenna and its associated matching circuitry may be coupled to a third signal port.

The third unbalanced antenna and its associated matching circuitry may be coupled to a fourth signal port.

In embodiments where the two-arm antenna is configured as a pair of unbalanced antennas with separate feeds, each arm of the two-arm antenna may be provided with its own matching circuitry. In this way, in addition to the first signal port, the two-arm antenna can be coupled to a fifth signal port.

Moreover, using the splitter circuits and matching circuits disclosed in WO 2013/014458 (the content of which is incorporated into the present disclosure by reference), it is possible for each of the first to third unbalanced antennas to drive two signal ports, the signals at each pair of signal ports being tuneable independently of each other.

Moreover, when the two-arm antenna is configured with the second arm as a groundplane and the first arm as a monopole (i.e. the first arm is an unbalanced antenna), then the two-arm antenna can drive two signal ports.

When the two-arm antenna is configured as a balanced dipole antenna, the two-arm antenna requires a balun and will only drive one signal port.

Where the two-arm antenna is configured as a pair of unbalanced antennas, each arm of the two-arm antenna can drive two signal ports.

Accordingly, an antenna device as disclosed herein may be configured with 4, 5, 6, 7, 8, 9 or 10 ports, each port being independently tuneable.

Alternatively or in addition, using the multi-band configurations disclosed in the present Applicant's co-pending UK patent application no GB1415780.4, it is possible for each signal port to support two or more independently tuneable signals.

As such, a single, small antenna device with a relatively small footprint can be used to support operation over a wide range of frequencies, in many different frequency bands.

Embodiments of the present device may be used for Multiple-Input-Multiple-Output (MIMO) applications, and also for diversity applications, where two or more signals in the same frequency band are distinguished by other characteristics such as polarization.

Polarization diversity, for example making use of phase shifts, for example 90 degree phase shifts, between certain matching circuits and/or signal ports, can be used to help improve isolation between signal ports.

The reconfigurable antenna device disclosed herein may be configured in a number of different ways depending on the requirements of a manufacturer of portable radio devices.

The antenna device may further comprise a control system which is connected to each signal port and which comprises a control means for selecting a desired operating mode.

The antenna device may be configured as a chassis antenna for use in a portable device.

The antenna device may be configured so that the second and third unbalanced antennas have respective distal ends that overlap but do not touch the respective distal portions of the first and second arms of the two-arm antenna, wherein the first and second opposed arms are connected together to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, wherein the second unbalanced antenna and the distal portion of the first arm, during operation, electromagnetically couple with each other so as to act as a bandstop filter to reduce propagation of RF signals to the third unbalanced antenna from the second unbalanced antenna, thereby to reduce coupling between the third and fourth signal ports at the given frequency band or bands, and wherein the third unbalanced antenna and the distal portion of the second arm, during operation, electromagnetically couple with each other so as to act as a bandstop filter to reduce propagation of RF signals to the second unbalanced antenna from the third unbalanced antenna, thereby to reduce coupling between the fourth and third signal ports at the given frequency band or bands.

Viewed from a second aspect, there is provided a reconfigurable antenna device comprising a substrate incorporating a first groundplane, a two-arm antenna having first and second opposed arms each having a proximal portion and a distal portion, a first unbalanced antenna located between the distal portions and adjacent to the proximal portions of the first and second arms, a second unbalanced antenna located adjacent to the first arm and a third unbalanced antenna located adjacent to the second arm, and the second and third unbalanced antennas being located in a plane that is substantially coplanar with or parallel to the substrate, wherein the second and third unbalanced antennas have respective distal ends that overlap but do not touch the respective distal portions of the first and second arms of the two-arm antenna, wherein the first and second opposed arms are connected together to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, wherein the second unbalanced antenna and the distal portion of the first arm, during operation, electromagnetically couple with each other so as to act as a bandstop filter to reduce propagation of RF signals to the third unbalanced antenna from the second unbalanced antenna, thereby to reduce coupling between the third and fourth signal ports at the given frequency band or bands, and wherein the third unbalanced antenna and the distal portion of the second arm, during operation, electromagnetically couple with each other so as to act as a bandstop filter to reduce propagation of RF signals to the second unbalanced antenna from the third unbalanced antenna, thereby to reduce coupling between the fourth and third signal ports at the given frequency band or bands.

The first unbalanced antenna may be configured to act as a resonator at the given frequency band or bands, thereby to reduce coupling between the third and fourth signal ports at the given frequency band or bands.

The antenna device may further comprise at least one parasitic resonator in the form of a resonant circuit located between the second and third unbalanced antennas.

The at least one parasitic resonator may be located in a plane substantially parallel to but not coplanar with the plane in which the second and third unbalanced antennas are located.

Alternatively or in addition, the at least one parasitic resonator is not coplanar with the first unbalanced antenna.

In some embodiments, the at least one parasitic resonator extends under or over at least a central portion of the first unbalanced antenna in a substantially parallel plane thereto.

The at least one parasitic resonator may act as a bandstop filter at a predetermined frequency band.

Viewed from a third aspect, there is provided reconfigurable antenna device comprising a substrate incorporating a first groundplane, a two-arm antenna having first and second opposed arms each having a proximal portion and a distal portion, a first unbalanced antenna located between the distal portions and adjacent to the proximal portions of the first and second arms, a second unbalanced antenna located adjacent to the first arm and a third unbalanced antenna located adjacent to the second arm, and the second and third unbalanced antennas being located in a plane that is substantially coplanar with or parallel to the substrate, wherein the second and third unbalanced antennas have respective distal ends that are located adjacent to but do not touch the respective distal portions of the first and second arms of the two-arm antenna, wherein the first and second opposed arms are connected together to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, and wherein a first resonant circuit configured to resonate in a first frequency band is located on the first unbalanced antenna between the first and second arms of the two-arm antenna; thereby to reduce coupling between the third and fourth signal ports in the first frequency band.

The device may further comprise a second resonant circuit, configured to resonate in a second frequency band different to the first frequency band, located on the first unbalanced antenna between the first and second arms of the two-arm antenna; thereby to reduce coupling between the third and fourth signal ports in the second frequency band.

A region at one end of the substrate where the antennas are mounted may be free of the first groundplane, the groundplane having an edge facing the end of the substrate where the antennas are mounted.

In some embodiments, the second and third unbalanced antennas have distal ends that overlap (but do not touch) the respective distal portions of the first and second arms of the two-arm antenna. The second and third unbalanced antennas may be disposed in a plane overlying a plane in which the two-arm antenna is disposed, and the distal ends of the second and third unbalanced antennas may be folded downwards through substantially 90 degrees towards the distal portions of the two-arm antenna. The folded structure allows high coupling between the two-arm antenna and each of the second and third unbalanced antennas. This can allow the two-arm antenna to act as a resonator, thus serving as a band-stop filter for the second and third unbalanced antennas. For example, when there is coupling, the current from the second unbalanced antenna needs to pass through the two-arm antenna and then to the third unbalanced antenna, and a 180 degree phase difference between the current distribution on the second unbalanced antenna and the current distribution on the third unbalanced antenna is obtained. This provides high isolation between the second and third unbalanced antennas.

In other embodiments, the second and third unbalanced antennas have distal ends that do not overlap the respective distal portions of the first and second arms of the two-arm antenna. The second and third unbalanced antennas may be disposed in a plane overlying or underlying a plane in which the two-arm antenna is disposed, or may be disposed in the same plane.

The first unbalanced antenna may be located between the distal portions of the two-arm antenna, generally adjacent to the proximal portions. The first unbalanced antenna may comprise an elongate conductive strip as a radiating element, having a length that is preferably substantially parallel to the proximal portions. A first half of the conductive strip of the first unbalanced antenna is located generally adjacent and parallel to the proximal portion of the first arm of the balanced antenna, with a second half being located generally adjacent and parallel to the proximal portion of the second arm. The first unbalanced antenna may be located in the same plane as the two-arm antenna, for example on the same surface of the substrate, or may be in a parallel plane, for example on an opposed surface of the substrate. The first unbalanced antenna may further comprise a central stub that extends towards but does not contact the first groundplane. The stub may provide a connection point for a feed to the first unbalanced antenna.

The at least one parasitic resonator may comprise a conductive strip disposed generally between but not touching the second and third unbalanced antennas. In certain embodiments, the conductive strip may be C- or U-shaped with a mouth or gate. A capacitor and/or inductor may be connected across the mouth or gate. The conductive strip may alternatively be H-, T-, I-, L- or O-shaped. The parasitic resonator may be provided in the same plane as the second and third unbalanced antennas, but preferably is provided in a different, substantially parallel plane. In preferred embodiments, the at least one parasitic resonator also extends under (or over) at least a central portion of the first unbalanced antenna. The at least one parasitic resonator may be provided on a surface of the substrate opposed to the surface on which the first and/or second and third unbalanced antennas are disposed, or may be located between an upper and lower surface of the substrate. Alternatively, the at least one parasitic resonator may be formed between two layers of a dielectric film and applied to a surface of the substrate.

Advantageously, the parasitic resonator may comprise a pair of C- or U-shaped conductive elements are provided. The elements may be of different sizes, with one nested inside the other. They may also have different orientations. The mouth or gate of one element may be aligned substantially parallel to the second and third unbalanced antennas, and the mouth or gate of the other element may be aligned substantially perpendicularly to the second and third unbalanced antennas. Alternatively, one element may be arranged with its mouth facing in a first direction, and the other element may be arranged with its mouth facing in an opposite direction.

In some embodiments, two parasitic resonators may be provided, one acting as a band-stop filter in a first frequency band, and the other as a band-stop filter in a second, different, frequency band.

Where at least two parasitic resonators are provided, they are preferably configured so as not to be in electrically conductive contact with each other.

Where the first unbalanced antenna is provided with a central stub, the at least one parasitic resonator may extend under (or over) the central stub.

The at least one parasitic resonator acts as a band-stop isolator between the second and third unbalanced antennas for a given frequency band. Where multiple resonators of different sizes and/or orientations are used, band-stop isolation at multiple frequency bands can be obtained.

The second unbalanced antenna may also comprise a conductive strip as a radiating element, and may be located adjacent to and substantially parallel to the first half of the first unbalanced antenna, and thus also generally adjacent to the first arm of the balanced antenna. The second unbalanced antenna may extend generally between the distal portion of the first arm of the two-arm antenna and the central stub of the first unbalanced antenna.

The third unbalanced antenna may also comprise a conductive strip as a radiating element, and may be located adjacent to and substantially parallel to the second half of the first unbalanced antenna, and thus also generally adjacent to the second arm of the two-arm antenna. The third unbalanced antenna may extend generally between the distal portion of the second arm of the two-arm antenna and the central stub of the first unbalanced antenna.

The second and/or the third unbalanced antennas may be mounted on the substrate in the same plane as the two-arm antenna, or in a different plane (for example on an opposed surface of the substrate, or sandwiched between opposed surfaces of the substrate, or elevated above the substrate for example by a dielectric spacer). The second and third unbalanced antennas need not be mounted in the same plane. In some embodiments, the second and third unbalanced antennas have substantially the same dimensions, and may be disposed symmetrically about the longitudinal axis of the substrate. Alternatively, the second and third unbalanced antennas have different dimensions.

The two-arm antenna and the first unbalanced antenna may be provided with substantially centrally located feed lines. The second and third unbalanced antennas may also be fed from a midpoint of the edge of the groundplane facing the region where the antennas are disposed.

Features described in connection with the first aspect may equally be used with the second and/or third aspects, and vice versa.

BRIEF DESCRIPTION OF THE DRAWINGS

Embodiments of the invention are further described hereinafter with reference to the accompanying drawings, in which.

DETAILED DESCRIPTION

Figure 1:
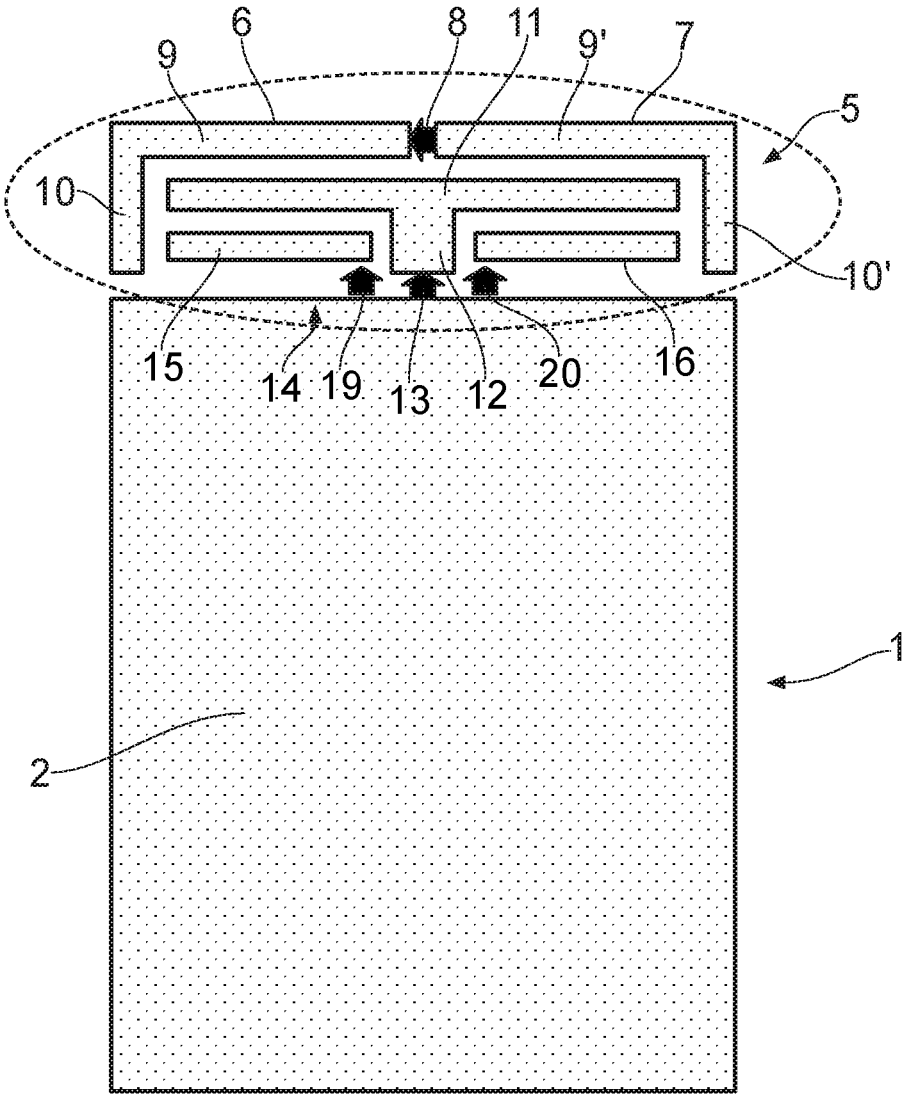
FIG. 1 shows a schematic plan view of a first embodiment.

FIG. 1 shows a first embodiment of a reconfigurable antenna device in schematic form. There is provided a substrate 1 including a first conductive groundplane 2 formed across a major portion of the upper surface of the substrate 1. The substrate 1 may be a PCB, for example FR4® or Duroid®. The substrate 1 of this embodiment has a generally rectangular shape, being configured as a PCB for a mobile phone handset. A two-arm antenna 5 (here configured as an unbalanced antenna driven against a floating groundplane) having first and second arms 6, 7 and a feed 8 is formed at one end of the substrate 1. The first and second arms 6, 7 may be formed from folded metal strips, for example copper strips, or may be etched or printed or otherwise formed as conductive strips or layers on the substrate 1. Each arm 6, 7 has a proximal portion 9, 9' and a distal portion 10, 10'. The distal portions 10, 10' extend substantially at right angles to the proximal portions 9, 9' towards the groundplane 2. The first and second arms 6, 7 in this embodiment are substantially symmetrical in a mirror plane.

In this embodiment, the second arm 7 of the two-arm antenna 5 is configured as a floating groundplane, and the first arm 6 is configured as an unbalanced antenna driven against the groundplane provided by the second arm 7.

There is further provided a first unbalanced antenna 11, located generally between the distal portions 10, 10' and adjacent to the proximal portions 9, 9' of the first and second arms 6, 7. The first unbalanced antenna 11 is formed as a conductive layer on the substrate 1 across the reduced width portion 4, generally parallel to an edge 14 of the first groundplane 2, and includes a central stub portion 12 connected to a feed 13.

There is further provided a second unbalanced antenna 15 located generally adjacent to the first arm 6 and a third unbalanced antenna 16 located generally adjacent to the second arm 7. The second and third unbalanced antennas 15, 16 each extend along the substrate 1 between the first unbalanced antenna 11 and the edge 14 of the groundplane 2. The second and third unbalanced antennas 15, 16 are provided with respective feeds 19, 20.

Figure 2:
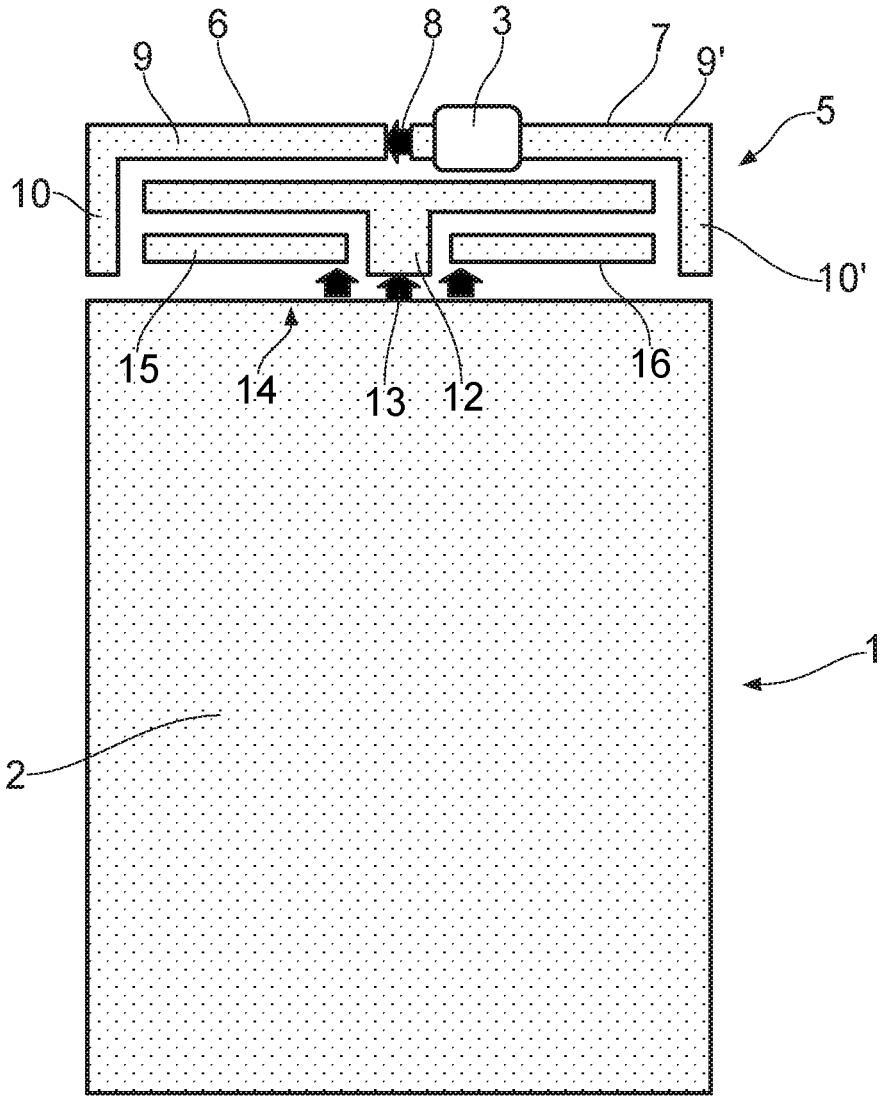
FIG. 2 shows a schematic plan view of a second embodiment with an RF front end system placed on a floating ground plane.

FIG. 2 shows a development of the embodiment of FIG. 1, where an RF front end system 3 is located on the floating groundplane provided by the second arm 7. By locating the RF front end system 3 on the second arm 7, there is no need to find space for it on the main groundplane 2, thus providing additional flexibility for configuring the other electronic components of a mobile handset (not shown).

Figure 3:
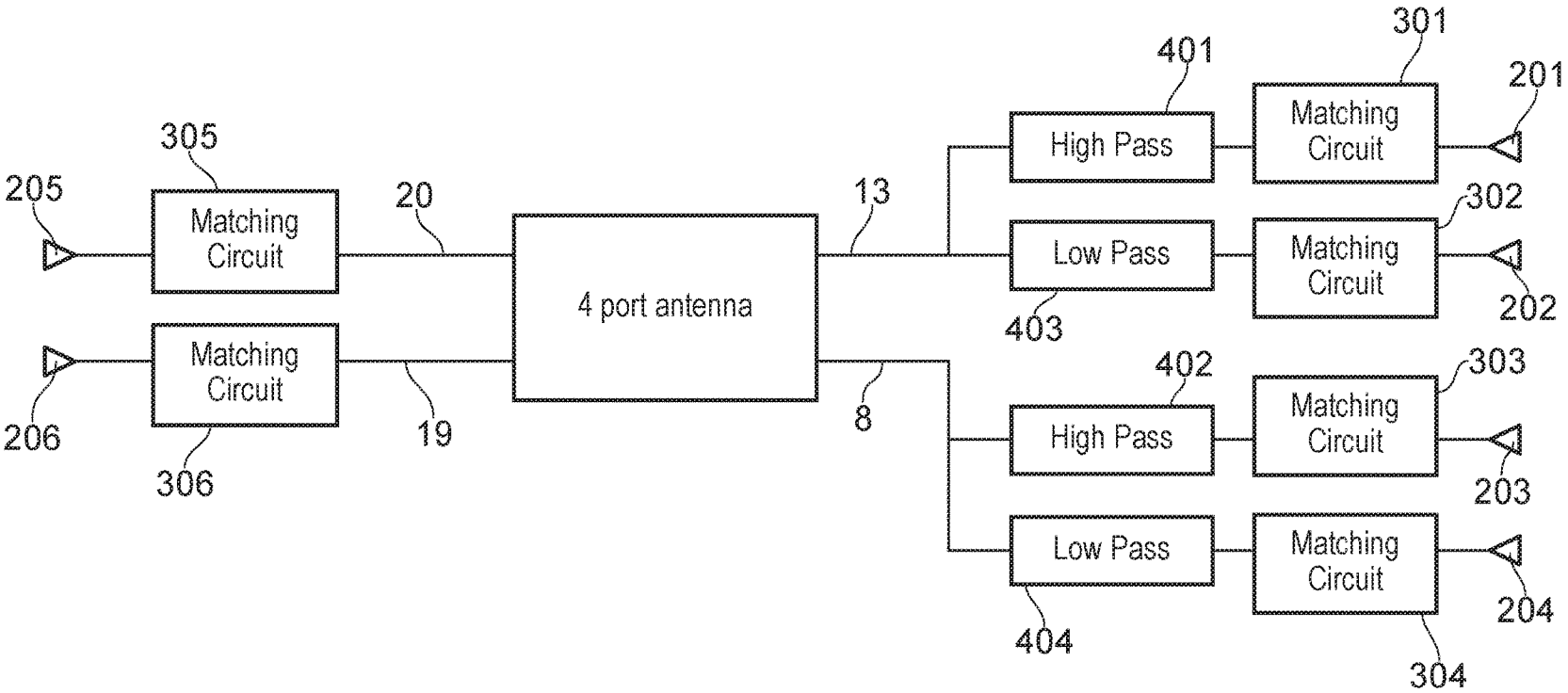
FIG. 3 shows a system block illustrating an implementation of embodiments configured for 6 port simultaneous operation.

FIG. 3 is a system block showing how the four antenna feeds 8, 13, 19 and 20 be connected to six signal ports 201, 202, 203, 204, 205 and 206 by way of six matching circuits or matching networks 301, 302, 303, 304, 305 and 306. The RF signals for antenna feeds 8 and 13 are split into high frequency and low frequency bands by high pass filters 401, 402 and low pass filters 403, 404. This is described in more detail in the present Applicant's co-pending UK patent application no GB1415780.4.

Figure 4:
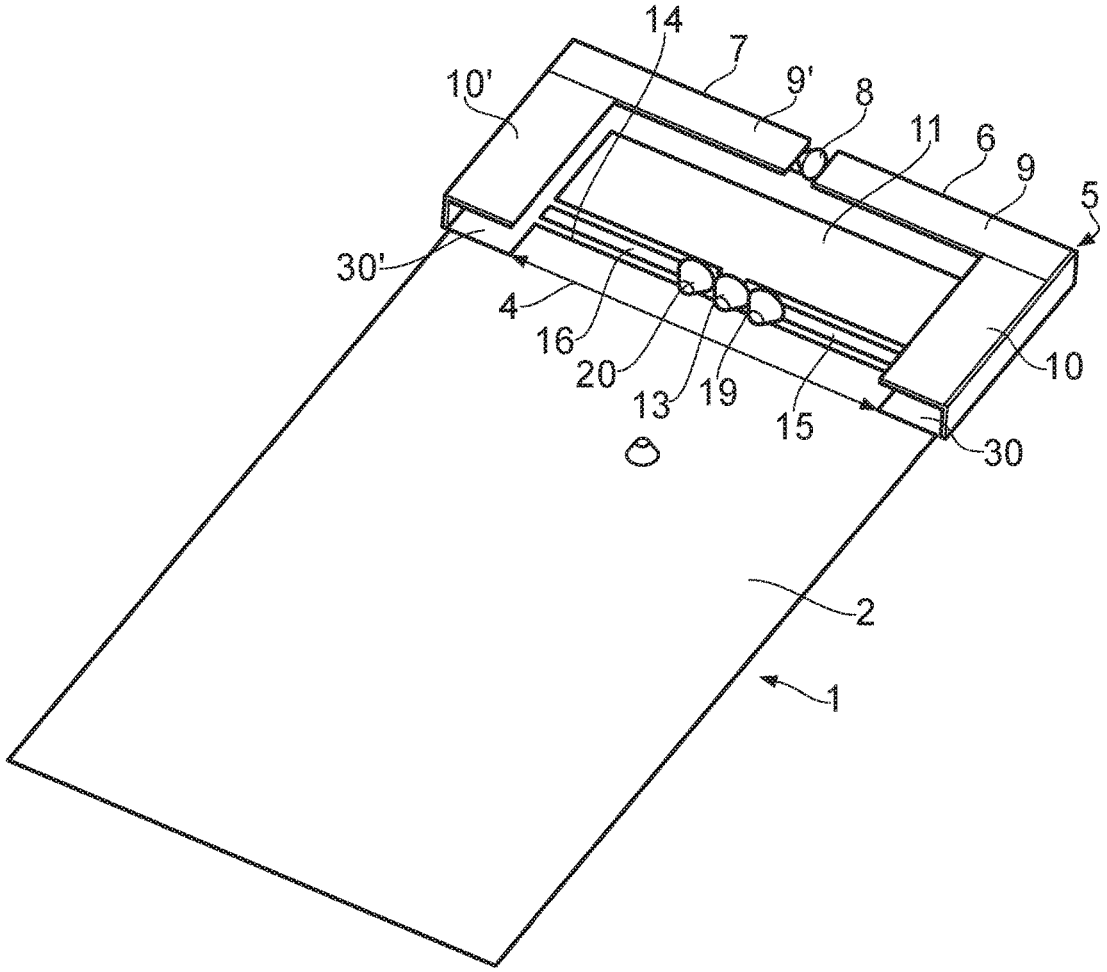
FIG. 4 shows a schematic perspective view of a third embodiment with a floating groundplane.

FIG. 4 shows an alternative configuration of the FIGS. 1 and 2 embodiments, with like parts being labelled as for FIGS. 1 and 2. In this embodiment, the substrate 1 has a generally rectangular shape, being configured as a PCB for a mobile phone handset. Two recesses 30, 30' are cut from the substrate 1 at one end thereof to provide a reduced width portion 4. The two-arm antenna 5 having first and second arms 6, 7 and a feed 8 is formed about the reduced width portion 4 of the substrate 1. The first and second arms 6, 7 are formed from folded metal strips, for example copper strips. Each arm 6, 7 has a proximal portion 9, 9' and a distal portion 10, 10'. The distal portions 10, 10' extend substantially at right angles to the proximal portions 9, 9' along the recesses 3, 3'. One arm 7 is configured as a floating groundplane against which the other arm 6 is driven as an unbalanced antenna. First, second and third unbalanced antennas 11, 15 and 16 are provided as previously described, and the antenna device as a whole has four feeds 8, 13, 19, 20.

Figure 5:
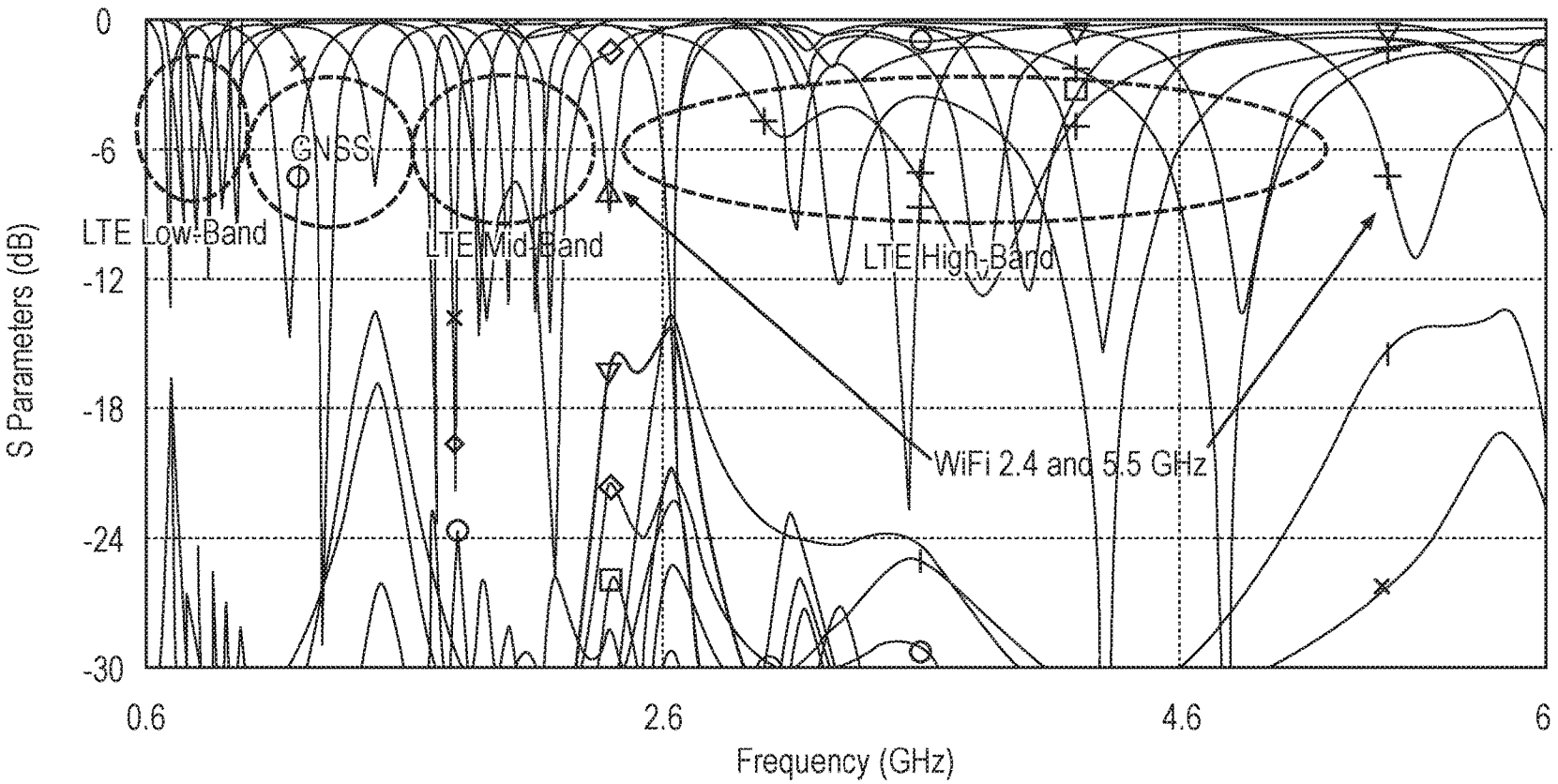
FIG. 5 shows a return loss plot for the embodiment of FIG. 4.

FIG. 5 is a return loss plot for the antenna device of FIG. 4 configured for 6 port operation as shown in FIG. 3. FIG. 5 shows that a single antenna device of a present embodiment can provide 6 port, multi-band, dual-MIMO operation over a frequency range of 700 MHz to 6 GHz. With reference to FIG. 3, signal ports 201 and 203, operating at the same frequency, as MIMO, can cover either the low-band or the mid-band for 4G LTE. Signal ports 202 and 204, operating at the same frequency, as MIMO, can cover either the mid-band or the high-band for 4G LTE. Signal ports 201 and 202, and signal ports 203 and 204, can together provide dual-MIMO simultaneous operation for 4G LTE. Signal port 205 is operating in the 2.4 GHz WiFi band. Signal port 206 can operate in either the 5.5 GHz WiFi band, or the GNSS bands (1.16 to 1.3 GHz and 1.5 GHz). Each signal port 201-206 is independently controllable. This means that if one port is tuned to a different frequency band, the other ports will continue to operate in the same frequency bands as before.

Figure 6:
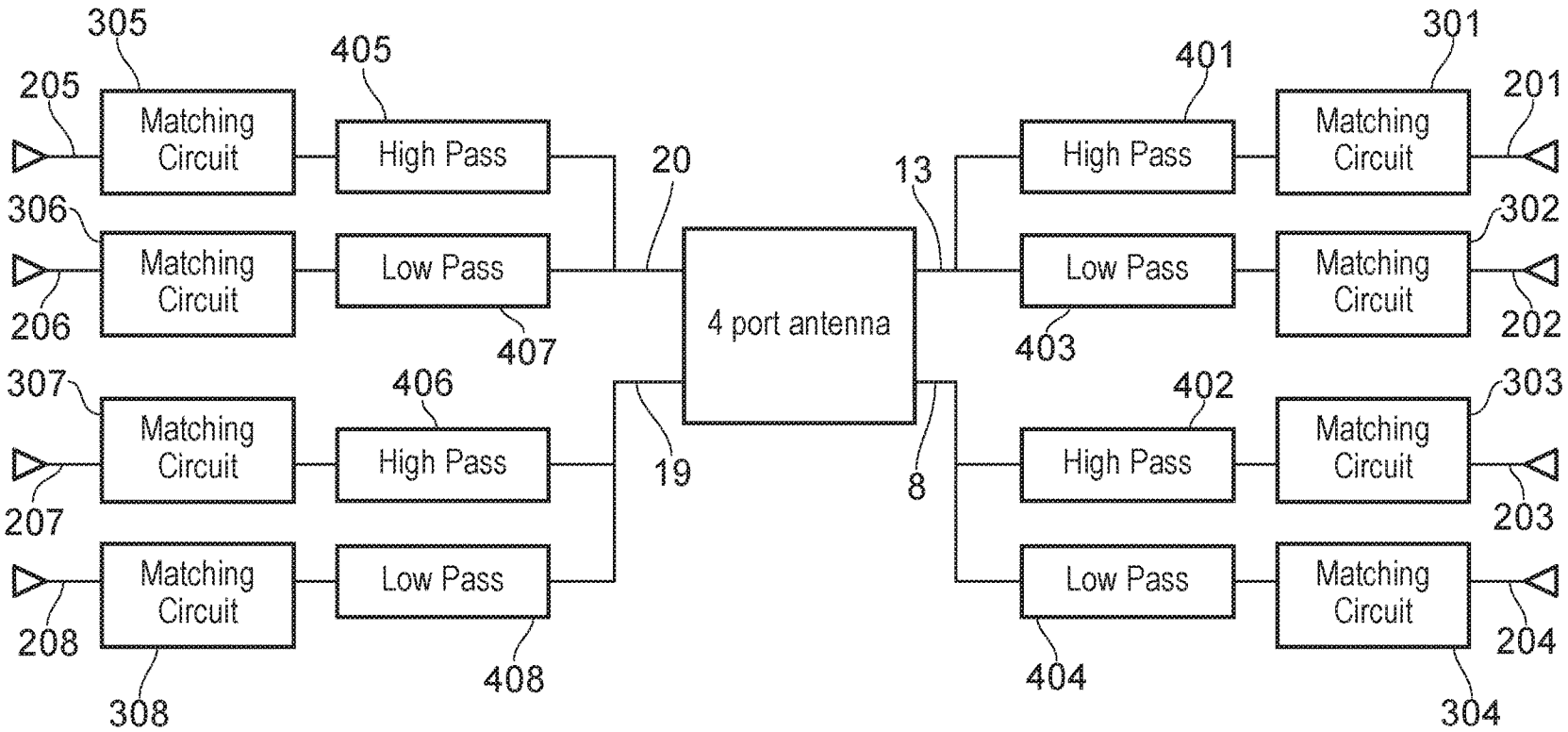
FIG. 6 shows a system block illustrating an implementation of embodiments configured for 8 port simultaneous operation.

FIG. 6 is a system block showing how the four antenna feeds 8, 13, 19 and 20 be connected to eight signal ports 201 to 208 by way of eight matching circuits or matching networks 301 to 308. The RF signals for antenna feeds 8, 13, 19 and 20 are split into high frequency and low frequency bands by high pass filters 401, 402, 405, 406 and low pass filters 403, 404, 407, 408.

Figure 7:
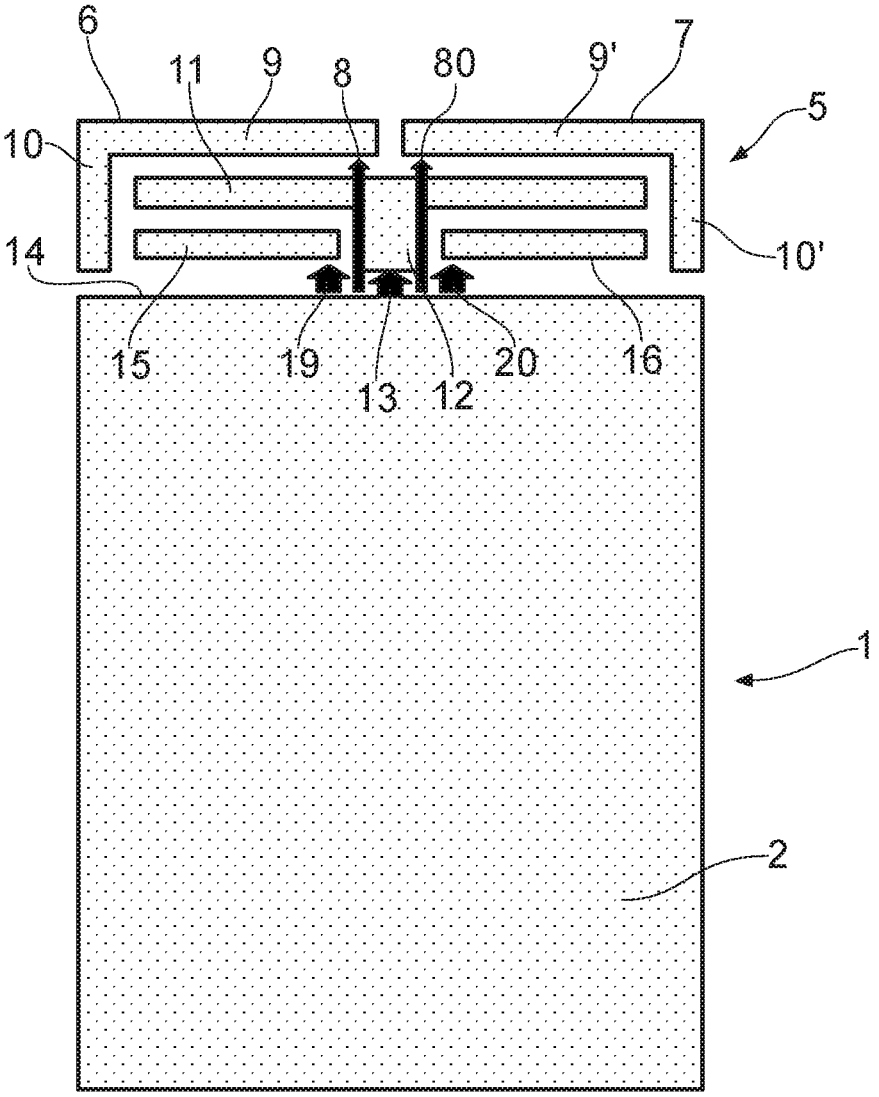
FIG. 7 shows a schematic plan view of a fourth embodiment.

FIG. 7 shows an alternative embodiment that is generally similar to that of FIG. 1, but with the important difference that the second arm 7 of the two-arm antenna 5, instead of being configured as a groundplane, is configured as an unbalanced antenna driven against the main groundplane 2. The first arm 6 of the two-arm antenna 5 is also configured as an unbalanced antenna, driven against the main groundplane 2. The first arm 6 and second arm 7 have separate feeds 8, 80. Accordingly, the antenna device as a whole has five feeds 8, 13, 19, 20 and 80.

Figure 8:
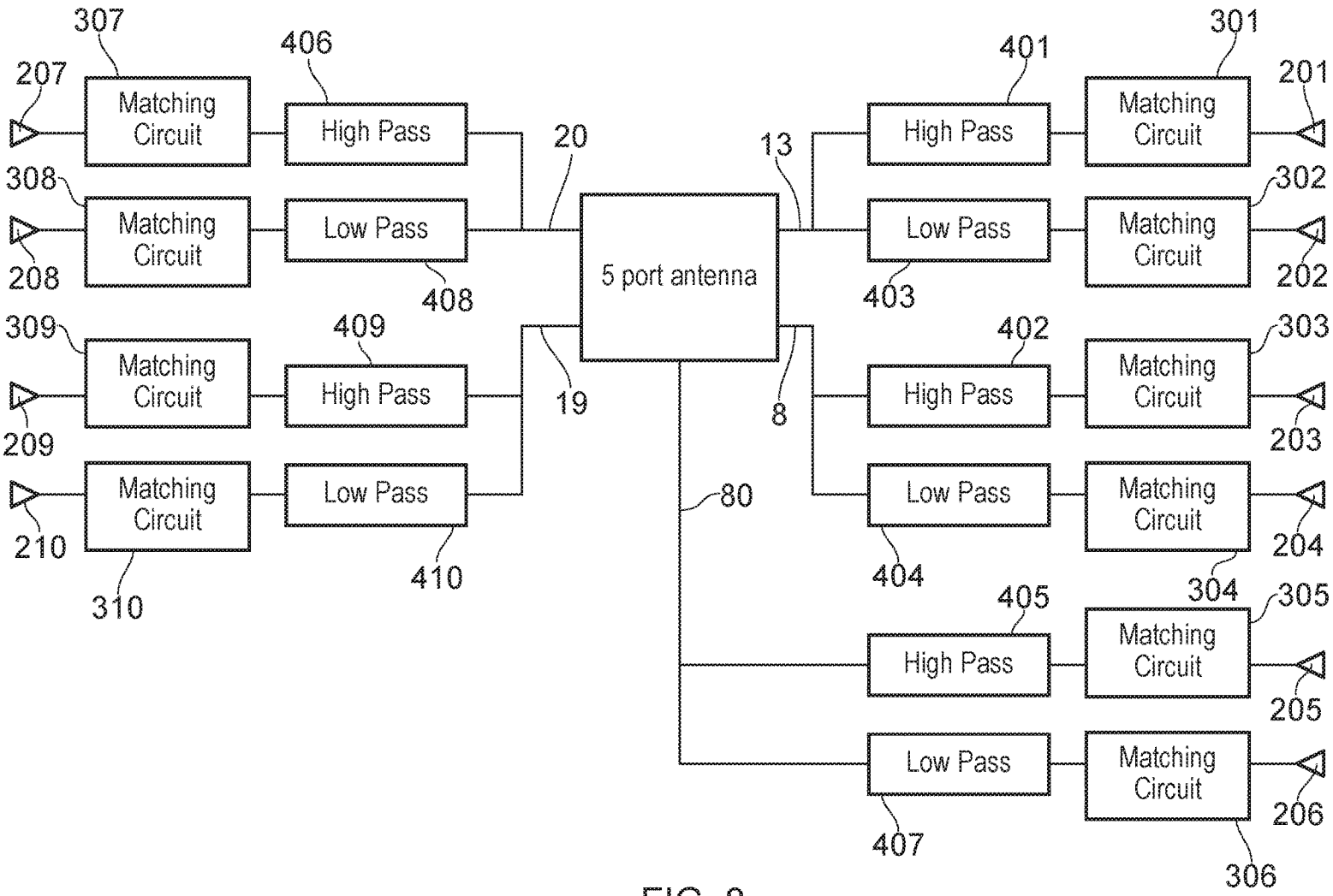
FIG. 8 shows a system block illustrating an implementation of the embodiment of FIG. 7 configured for 10 port simultaneous operation.

FIG. 8 is a system block showing how the five antenna feeds 8, 13, 19, 20 and 80 of the FIG. 7 embodiment can be connected to ten signal ports 201 to 210 by way of ten matching circuits or matching networks 301 to 310. The RF signals for antenna feeds 8, 13, 19, 20 and 80 are split into high frequency and low frequency bands by high pass filters 401, 402, 405, 406, 409 and low pass filters 403, 404, 407, 408, 410.

Figure 9:
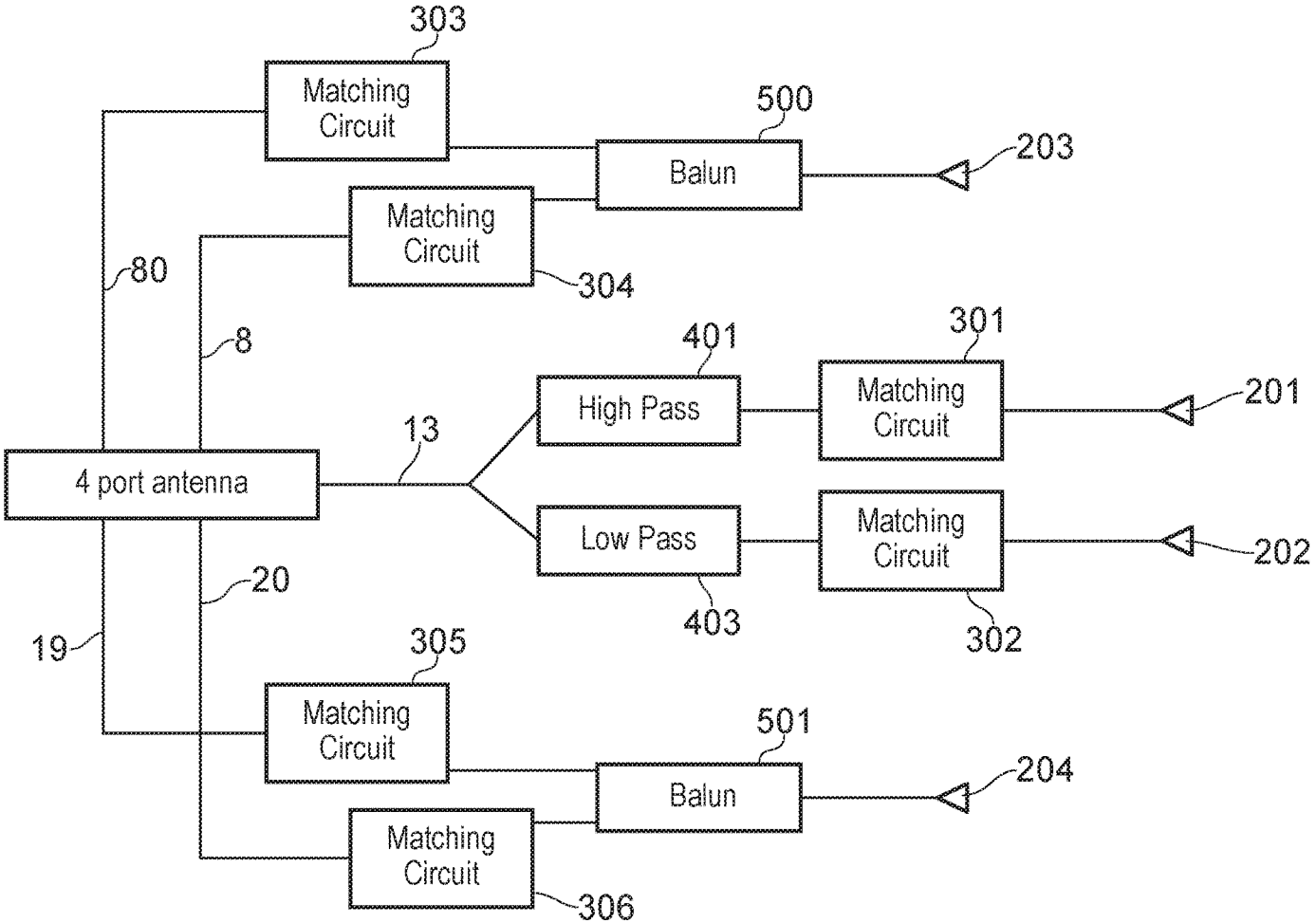
FIG. 9 shows a system block illustrating an implementation of embodiments configured for 4 port simultaneous operation.

FIG. 9 is a system block showing how the five antenna feeds 8, 13, 19, 20 and 80 of the FIG. 7 embodiment can be connected to four signal ports 201 to 204 by way of six matching circuits or matching networks 301 to 306. The RF signals for antenna feed 13 are split into high frequency and low frequency bands by high pass filter 401 and low pass filter 403. The RF signals for antenna feeds 8 and 80 can be converted by balun 500 (when the first and second arms 6, 7 operate together as a dipole in balanced mode). Likewise, the RF signals for antenna feeds 19 and 20 can be converted by balun 501 (when the second and third unbalanced antennas 15, 16 operate together as a dipole in balanced mode).

Figure 10:
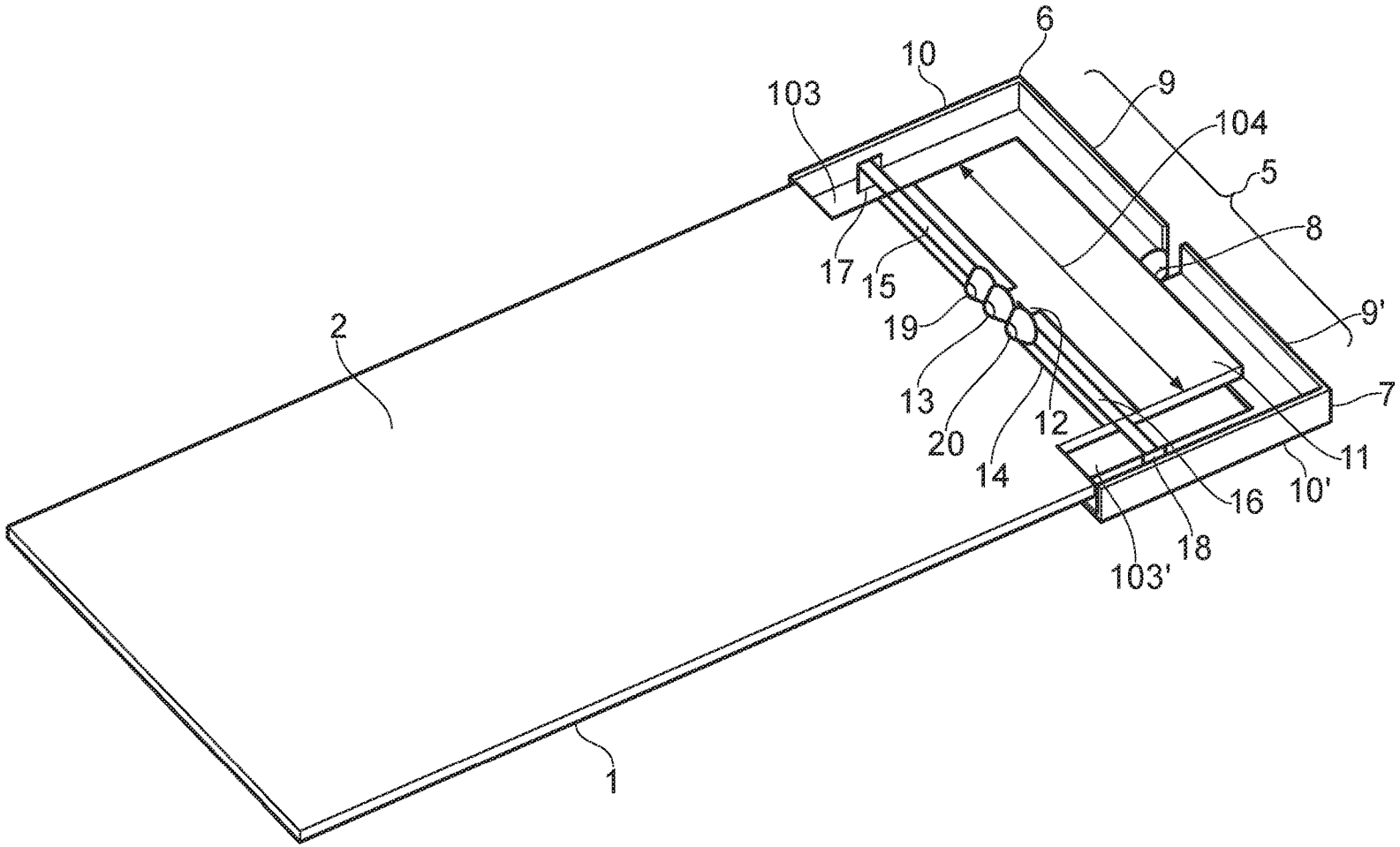
FIG. 10 shows a view from above of a further embodiment.

FIG. 10 shows a further embodiment of a reconfigurable antenna device. There is provided a substrate 1 including a first conductive groundplane 2 formed across a major portion of the upper surface of the substrate 1. The substrate 1 may be a PCB, for example FR4® or Duroid®. The substrate 1 of this embodiment has a generally rectangular shape, being configured as a PCB for a mobile phone handset. Two recesses 103, 103' are cut from the substrate 1 at one end thereof to provide a reduced width portion 104. A two-arm antenna 5 (here configured as a substantially symmetric balanced dipole antenna) having first and second radiating arms 6, 7 and a central feed 8 is formed about the reduced width portion 104 of the substrate. The first and second radiating arms 6, 7 may be formed from folded metal strips, for example copper strips. Each radiating arm 6, 7 has a proximal portion 9, 9' and a distal portion 10, 10'. The distal portions 10, 10' extend substantially at right angles to the proximal portions 9, 9' along the recesses 103, 103'.

There is further provided a first unbalanced antenna 11, located generally between the distal portions 10, 10' and adjacent to the proximal portions 9, 9' of the first and second radiating arms 6, 7. The first unbalanced antenna 11 is formed as a conductive layer on the substrate 1 across the reduced width portion 104, generally parallel to an edge 14 of the first groundplane 2, and includes a central stub portion 12 connected to a feed 13.

There is further provided a second unbalanced antenna 15 located generally adjacent to the first radiating arm 6 and a third unbalanced antenna 16 located generally adjacent to the second radiating arm 7. The second and third unbalanced antennas 15, 16 each have a portion that extends along the substrate 1 between the first unbalanced antenna 11 and the edge 14 of the groundplane 2, and a portion that extends from the edge of the reduced width portion 4 of the substrate 1 and overhangs the respective distal portion 10, 10' of the balanced antenna 5. The distal ends 17, 18 of the second and third unbalanced antennas 15, 16 may be folded down substantially through a right angle. It is to be noted that the distal ends 17, 18 do not contact the first and second radiating arms 6, 7, but are spaced therefrom by a distance 'D'. The second and third unbalanced antennas 15, 16 are provided with respective feeds 19, 20. The feeds 13, 19, 20 are all co-located at a midpoint of the edge 14 of the groundplane 2. It can be seen that all of the antennas are fed from a central longitudinal zone that follows a general line of mirror symmetry along the substrate 1. This helps to promote antenna isolation, and also simplifies the feeding arrangement, since all of the matching circuits for the various antennas can conveniently be provided in a single integrated circuit or chip mounted in the central longitudinal zone.

Figure 11:
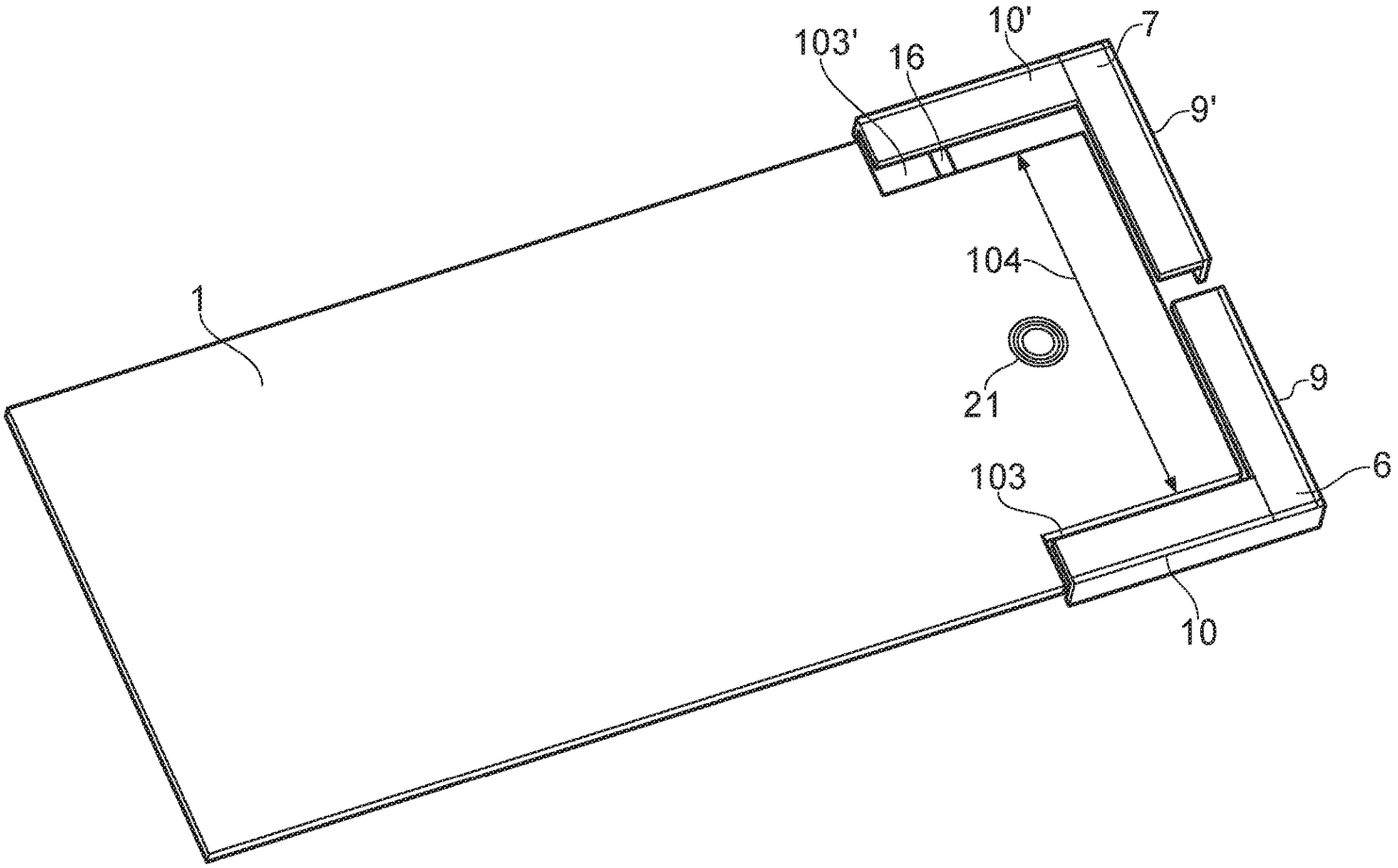
FIG. 11 shows a view from below of the embodiment of FIG. 10.

As shown in FIG. 11, the underside of the substrate 1 is provided with a parasitic resonator 21 in the form of a pair of oppositely-directed C-shaped conductive tracks, one nested inside the other. The parasitic resonator 21 is located on the underside of the substrate 1 generally opposite to the location on the topside of the substrate 1 of the central stub portion 12 of the first unbalanced antenna 11, which is between proximal ends of the second and third unbalanced antennas 15, 16. In this example, the parasitic resonator 21 is located in a plane substantially parallel to but not coplanar with the plane in which the second and third unbalanced antennas 15, 16 are located. Moreover, the first unbalanced antenna 11 is coplanar with proximal portions of the second and third unbalanced antennas 15, 16.

Figure 12:
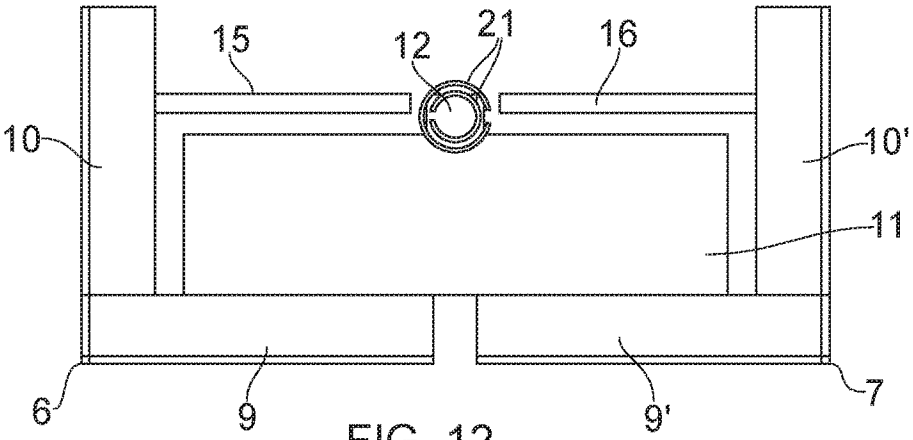
FIG. 12 shows an underplan view of the radiating elements of the embodiment of FIGS. 10 and 11.
Figure 13:
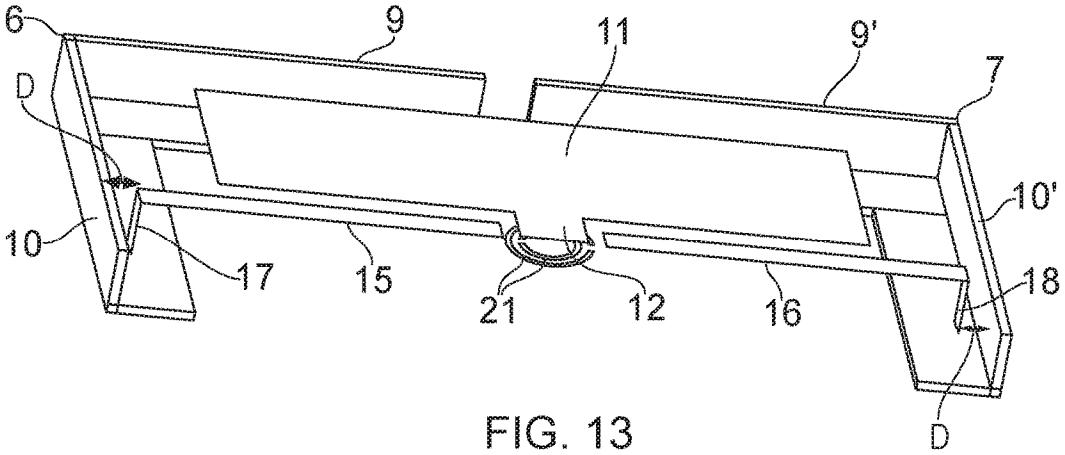
FIG. 13 shows a perspective view of the radiating elements of the embodiment of FIGS. 10 and 11.

FIGS. 12 and 13 show, respectively, an underplan and a perspective view of the radiating elements and parasitic resonator of the embodiment of FIGS. 10 and 11, with the substrate 1 being omitted for clarity.

Figure 14:
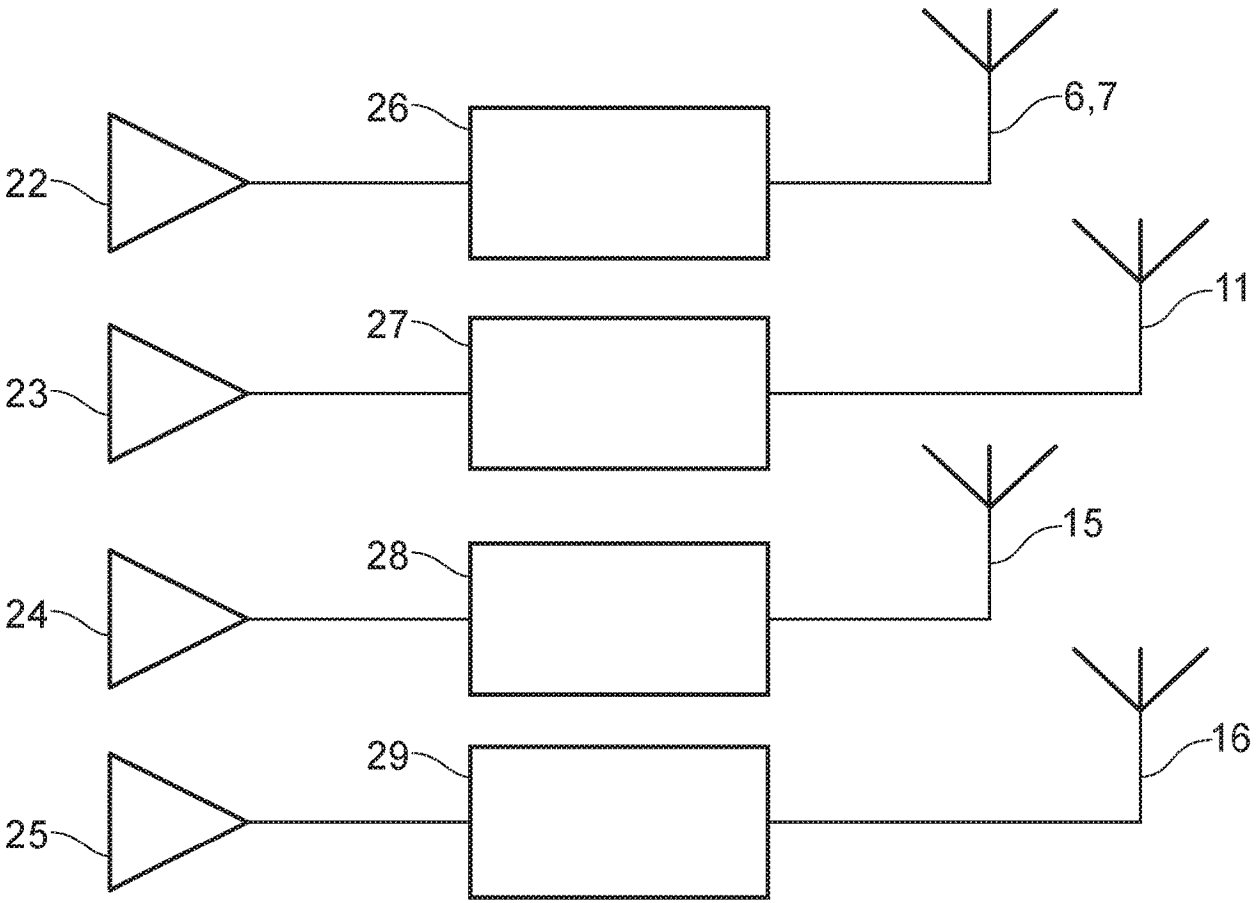
FIG. 14 shows a system block illustrating an implementation of the embodiment of FIGS. 10 and 11.

FIG. 14 is a system block showing how the balanced antenna 5 (with radiating arms 6, 7), first unbalanced antenna 11, second unbalanced antenna 15 and third unbalanced antenna 16 can be connected to four signal ports 22, 23, 24 and 25 by way of four matching circuits or matching networks 26, 27, 28, 29.

Figure 15:
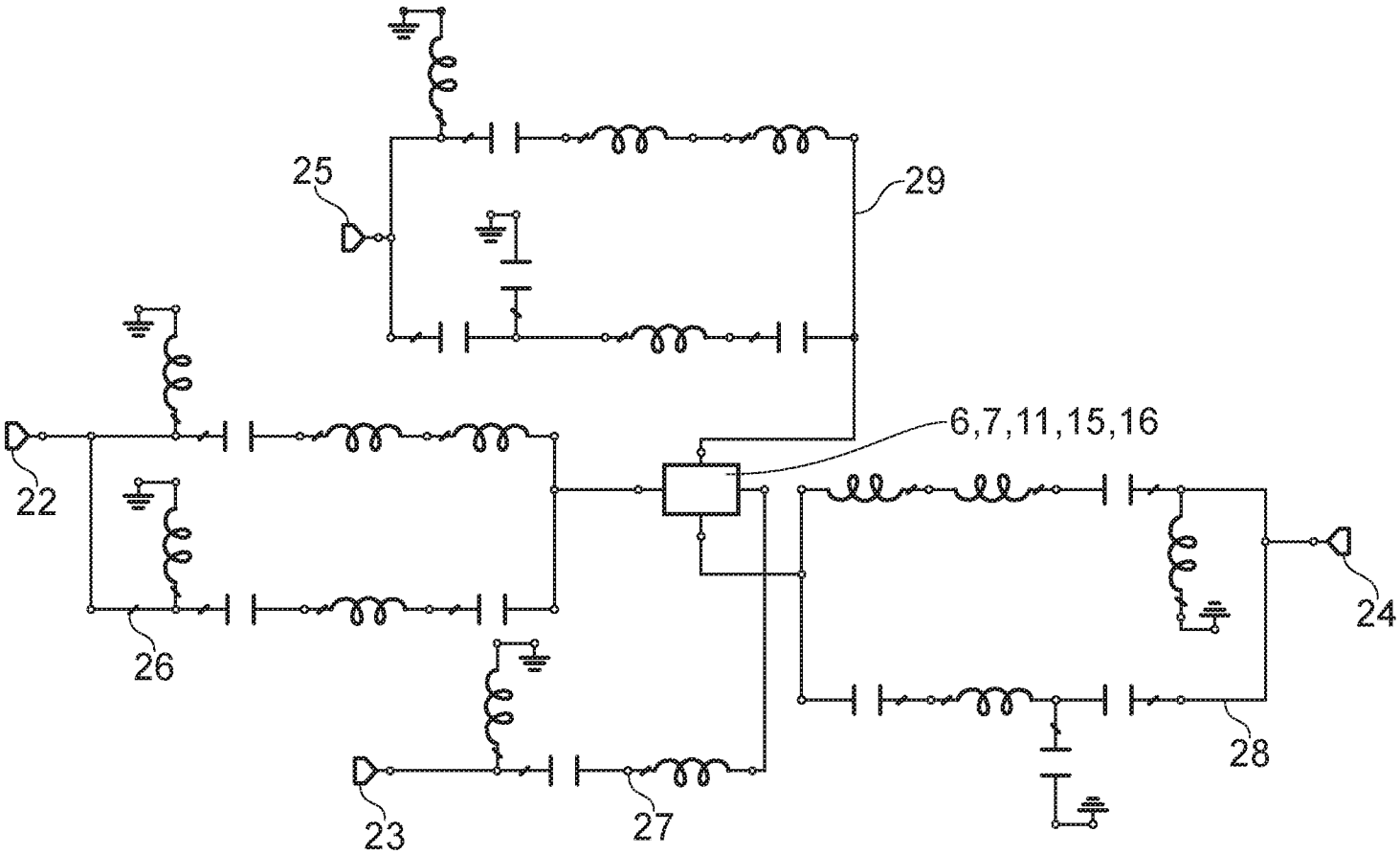
FIG. 15 shows an exemplary circuit diagram for the matching networks of FIG. 14.

FIG. 15 shows details of one possible arrangement of matching networks, each matching network comprising a suitable arrangement of capacitors and inductors, and each matching network being tuned to a predetermined frequency band. It will be apparent to those of ordinary skill that different arrangements of capacitors and inductors may be used.

Figure 16:
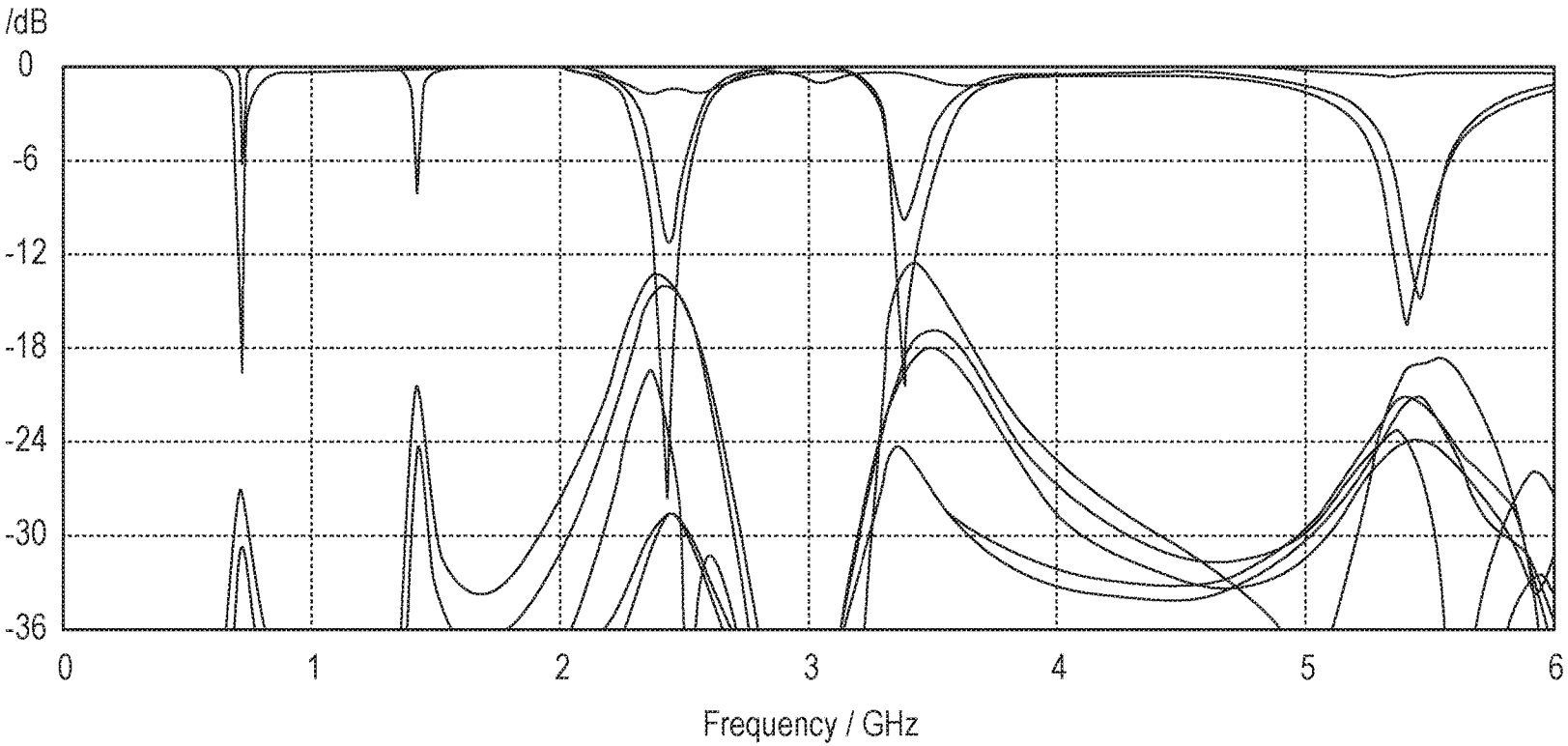
FIG. 16 is a plot showing the frequency response of the embodiment of FIGS. 10 and 11.

FIG. 16 is a plot showing the frequency response of the embodiment of FIGS. 10 to 15, demonstrating that the antenna device can operates in several well-defined frequency bands.

Figure 17:
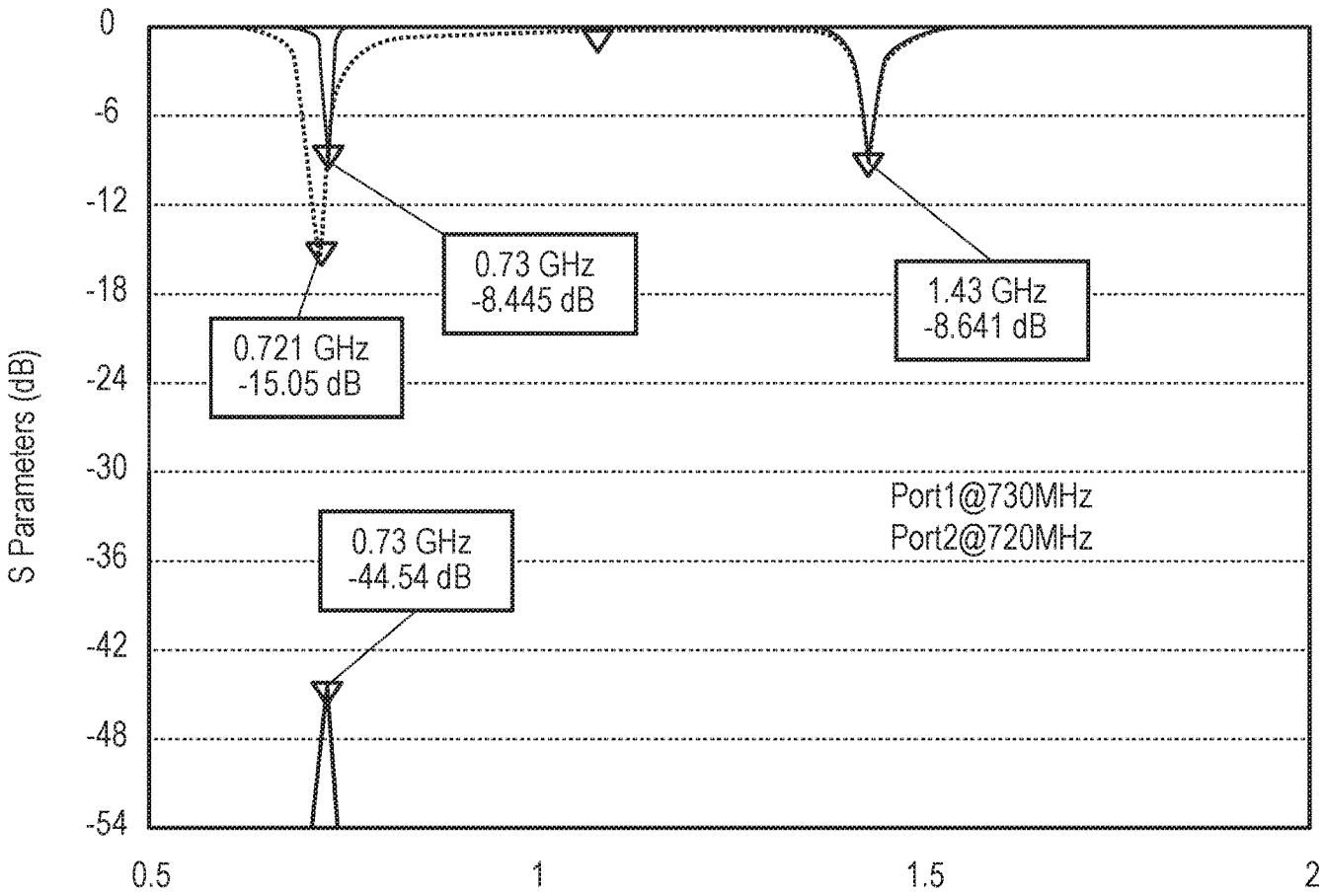
FIG. 17 shows the return loss for first and second ports of the embodiment of FIGS. 10 and 11.

FIG. 17 shows the return loss for the first and second ports 22 and 23 of this embodiment, the first port 22 being connected to the balanced antenna 5 and the second port 23 being connected to the first unbalanced antenna 11. The first port 22 shows a good response with good isolation at around 730 MHz, while the second port 23 shows a good response at around 720 MHz.

Figure 18:
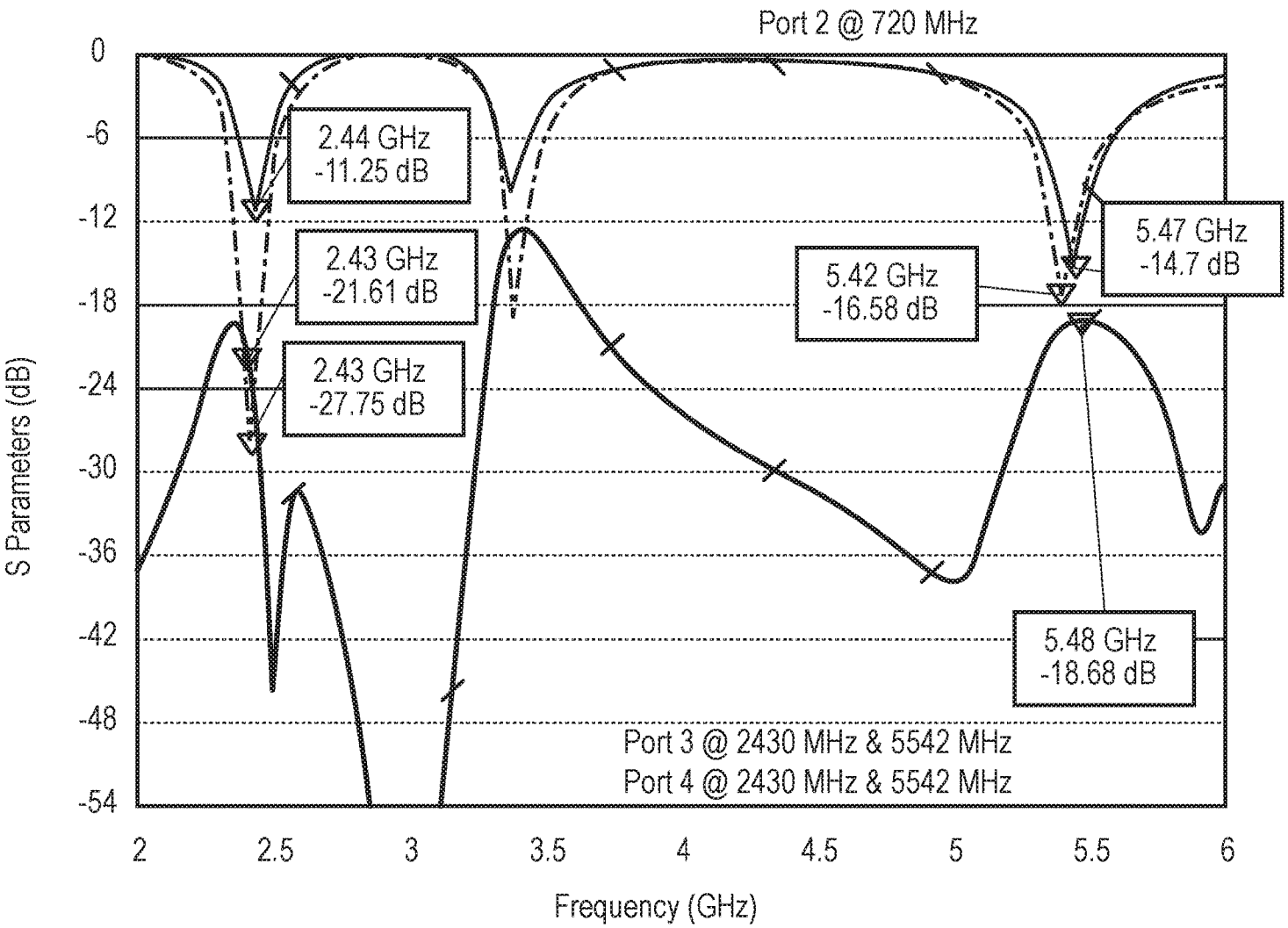
FIG. 18 shows the return loss for second, third and fourth ports of the embodiment of FIGS. 10 and 11.

FIG. 18 shows the return loss for the second, third and fourth ports 23, 24, 25 of this embodiment, the second port 23 being connected to the first unbalanced antenna 11, the third port 24 being connected to the second unbalanced antenna 15 and the fourth port 25 being connected to the third unbalanced antenna 16. The third port 24 and fourth port each show a good response with good isolation at around 2430 MHz and 5542 MHz.

Figure 19:
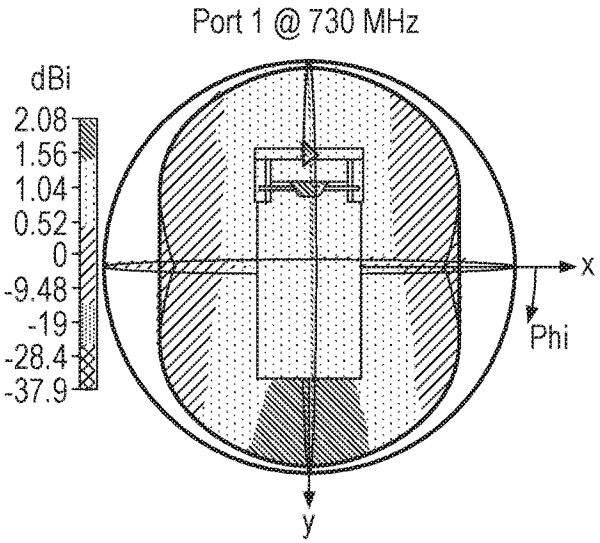
FIG. 19 shows the radiation pattern for the first port at 730 MHz.
Figure 20:
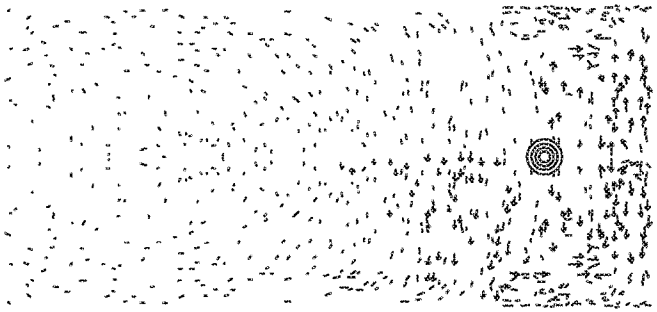
FIG. 20 shows the surface current distribution on the groundplane for the first port at 730 MHz.

FIG. 19 shows the radiation pattern associated with the balanced antenna 5 and the first port 22 at 730 MHz, with FIG. 20 showing the associated surface current distribution on the groundplane and in the radiating elements.

Figure 21:
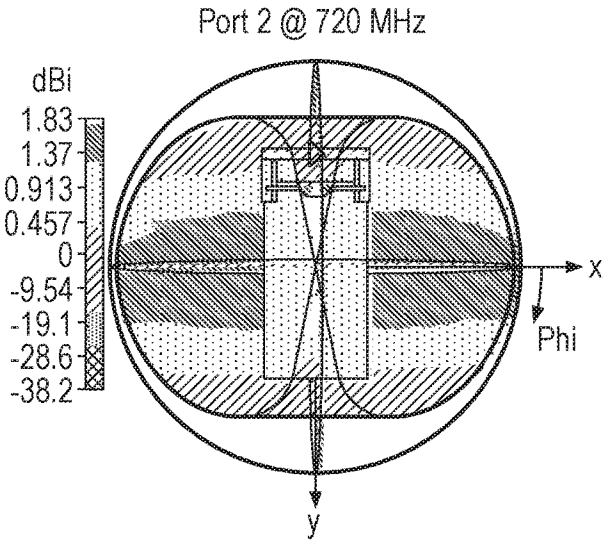
FIG. 21 shows the radiation pattern for the second port at 720 MHz.
Figure 22:
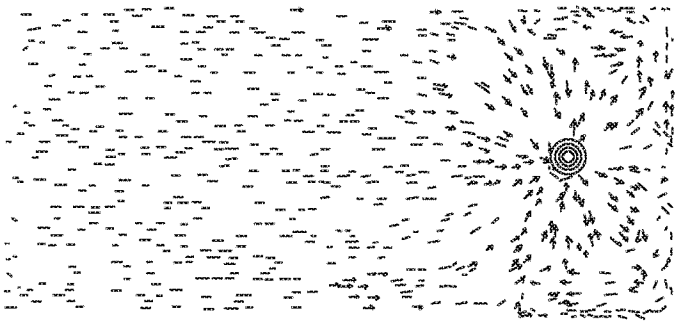
FIG. 22 shows the surface current distribution on the groundplane for the second port at 720 MHz.

FIG. 21 shows the radiation pattern associated with the first unbalanced antenna 11 and the second port 23 at 720 MHz, with FIG. 22 showing the associated surface current distribution on the groundplane and in the radiating elements.

Figure 23:
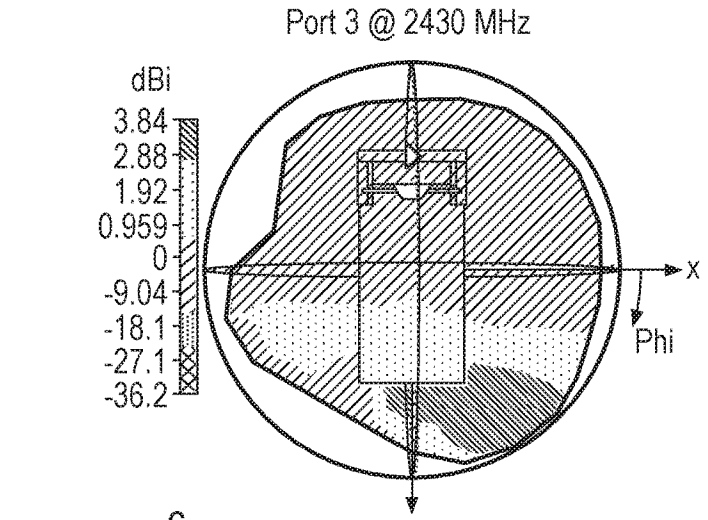
FIG. 23 shows the radiation pattern for the third port at 2430 MHz.
Figure 24:
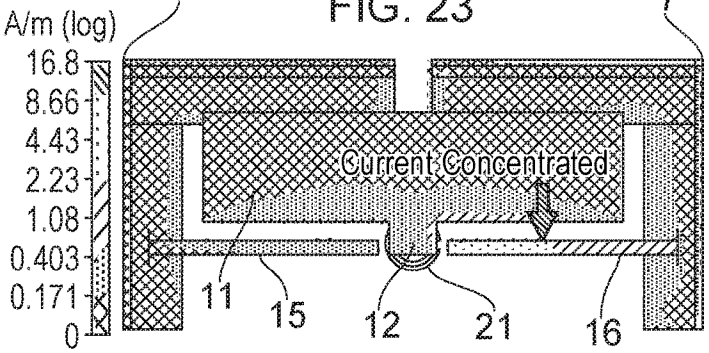
FIG. 24 shows the current distribution in the radiating elements for the third port at 2430 MHz.

FIG. 23 shows the radiation pattern associated with the second unbalanced antenna 15 and the third port 24 at 2430 MHz, with FIG. 24 showing the associated current distribution in the radiating elements.

Figure 25:
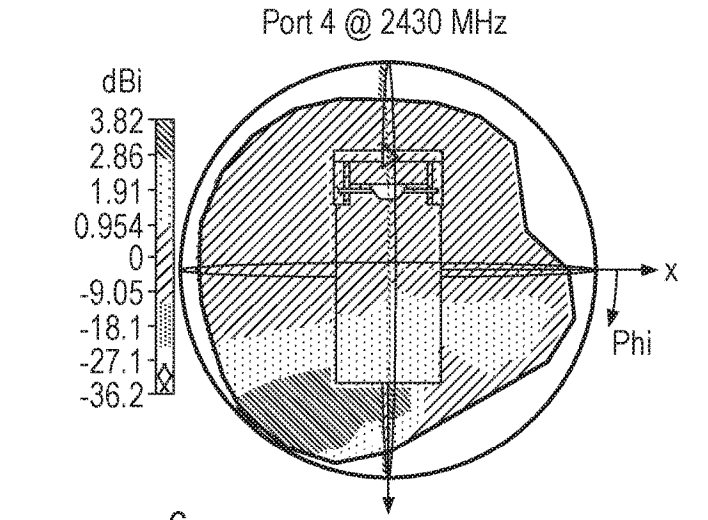
FIG. 25 shows the radiation pattern for the fourth port at 2430 MHz.
Figure 26:
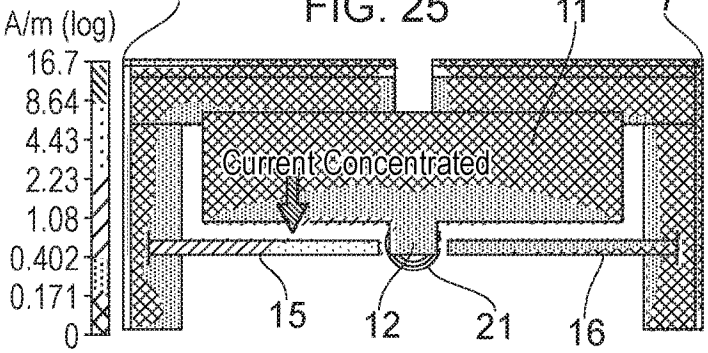
FIG. 26 shows the current distribution in the radiating elements for the fourth port at 2430 MHz.

FIG. 25 shows the radiation pattern associated with the third unbalanced antenna 16 and the fourth port 25 at 2430 MHz, with FIG. 26 showing the associated current distribution in the radiating elements.

Figure 27:
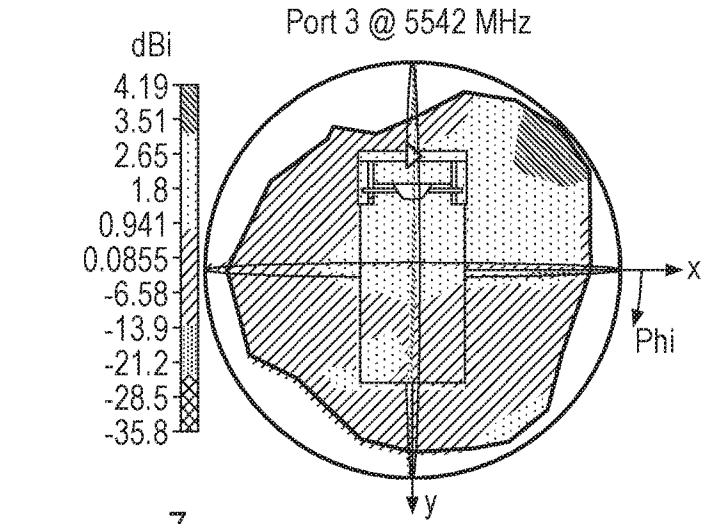
FIG. 27 shows the radiation pattern for the third port at 5542 MHz.
Figure 28:
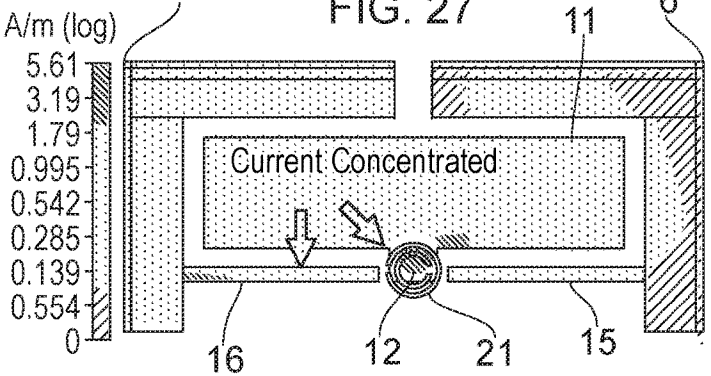
FIG. 28 shows the current distribution in the radiating elements for the third port at 5542 MHz.

FIG. 27 shows the radiation pattern associated with the second unbalanced antenna 15 and the third port 24 at 5542 MHz, with FIG. 28 showing the associated current distribution in the radiating elements.

Figure 29:
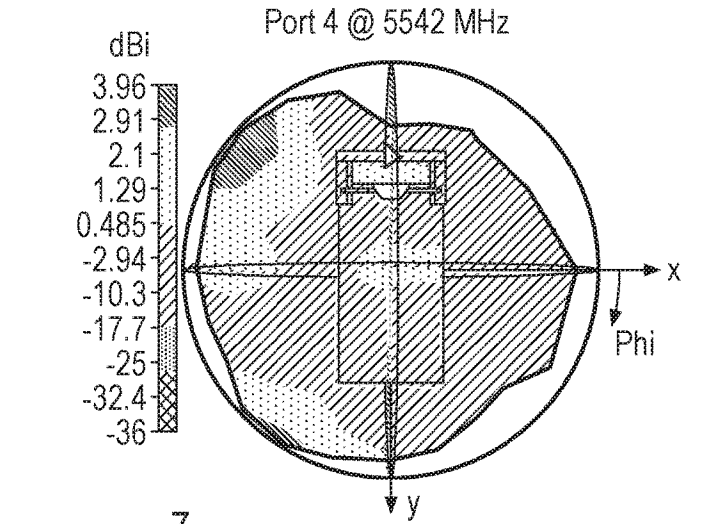
FIG. 29 shows the radiation pattern for the fourth port at 5542 MHz.
Figure 30:
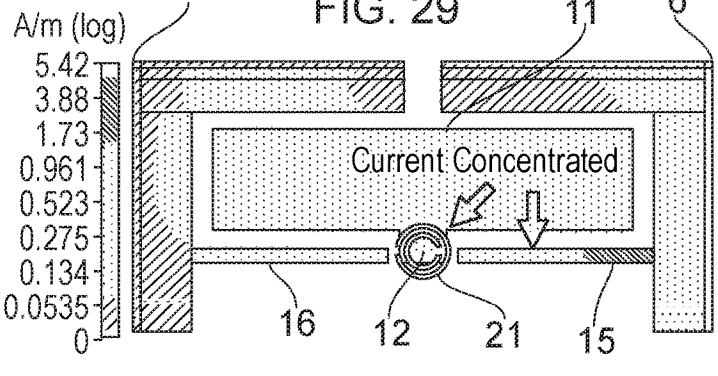
FIG. 30 shows the current distribution in the radiating elements for the fourth port at 5542 MHz.

FIG. 29 shows the radiation pattern associated with the third unbalanced antenna 16 and the fourth port 25 at 5542 MHz, with FIG. 30 showing the associated current distribution in the radiating elements.

As clearly demonstrated in FIGS. 23 to 30, the parasitic resonator 21 acts as a band-stop filter to improve isolation between the third and fourth ports 24, 25 at the higher frequencies, here 5542 MHz. Isolation is only at the higher frequencies because the resonator 21 is relatively short.

Figure 31:
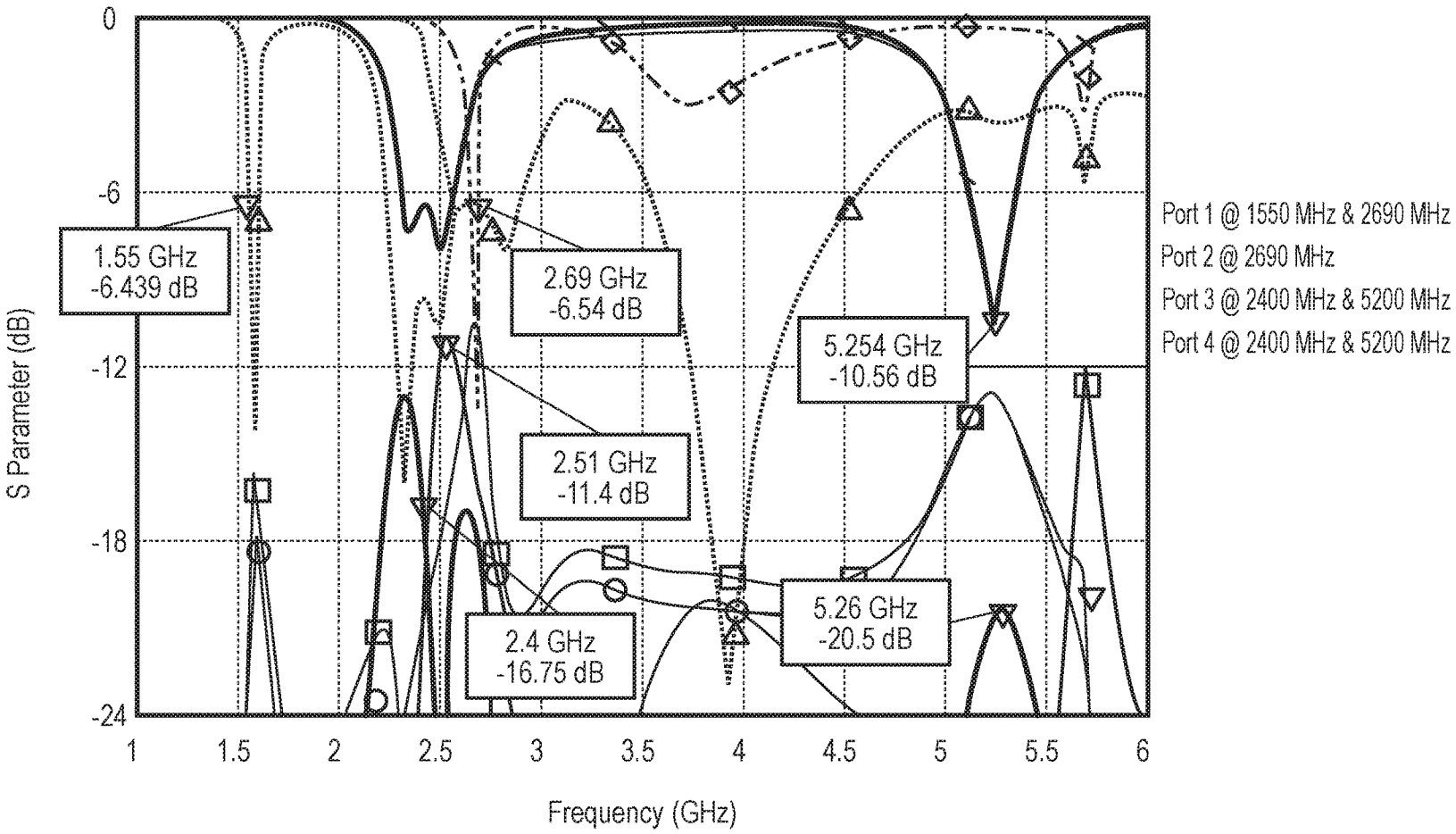
FIG. 31 shows the return loss for the first to fourth ports at various frequencies.

FIG. 31 shows the return loss for all four ports, with the first port 22 operating at 1550 MHz and 2690 MHz, the second port 23 at 2690 MHz, the third port 24 at 2400 MHz and 5200 MHz, and the fourth port 25 at 2400 MHz and 5200 MHz.

Figure 32:
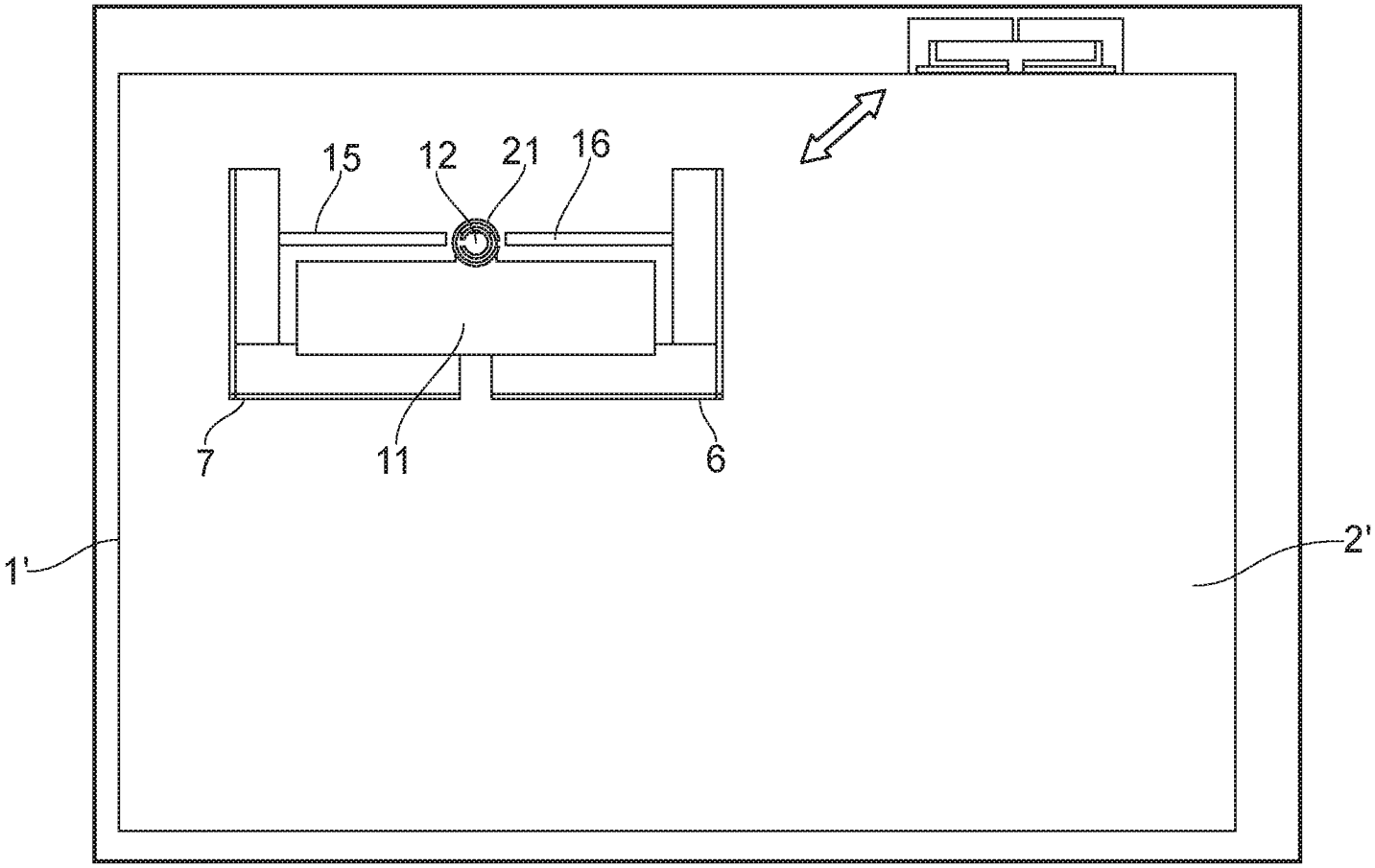
FIG. 32 shows a further embodiment configured for use with a large groundplane, for example in a laptop or tablet computer.

FIG. 32 shows an alternative embodiment, in which an antenna device as herein disclosed is mounted at an offset location on a longer edge of a large substrate 1' with a large groundplane 2'. The large substrate 1' may be a PCB of a tablet or laptop computer.

Figure 33:
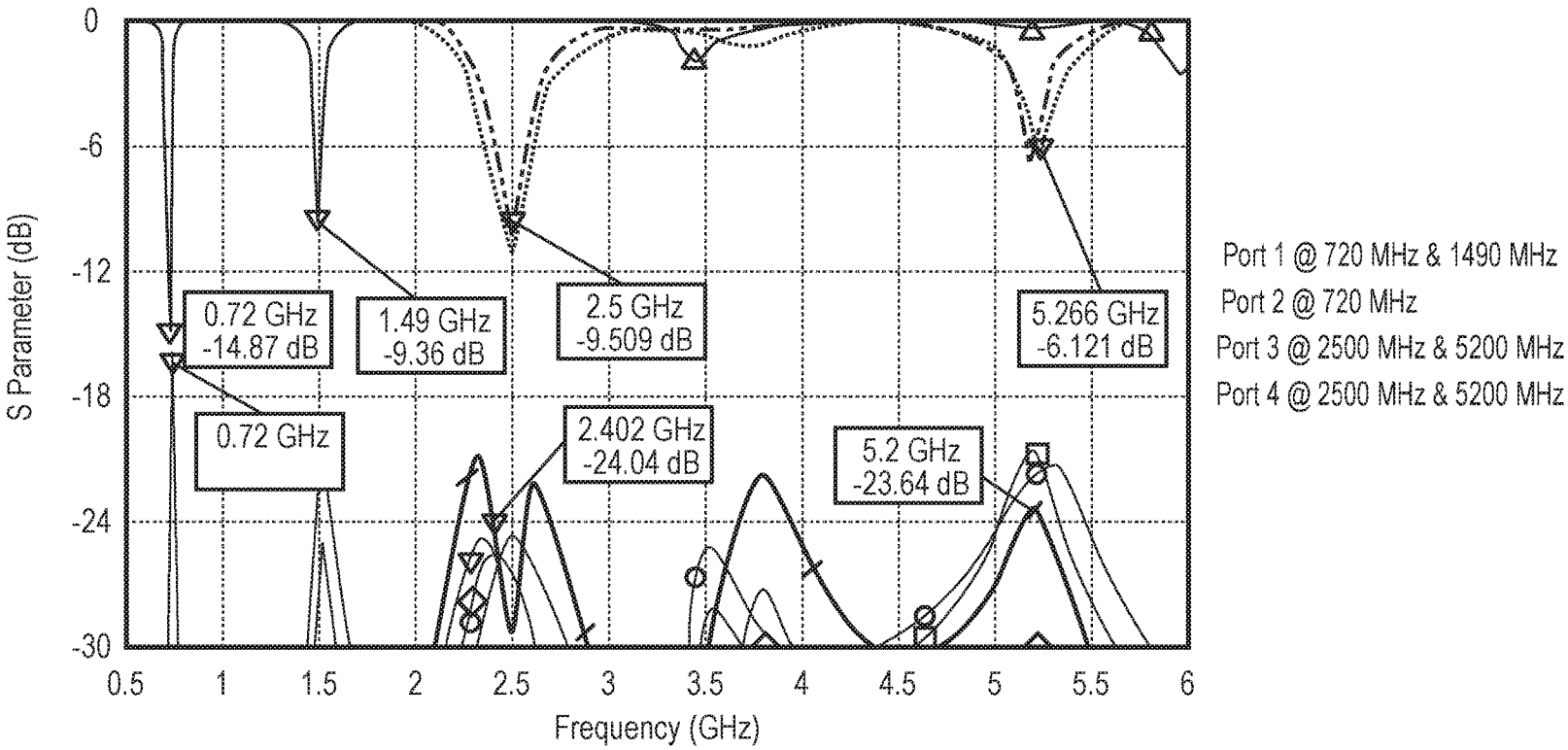
FIG. 33 shows the return loss for the first to fourth ports of the embodiment of FIG. 32 at various frequencies.
Figure 36:
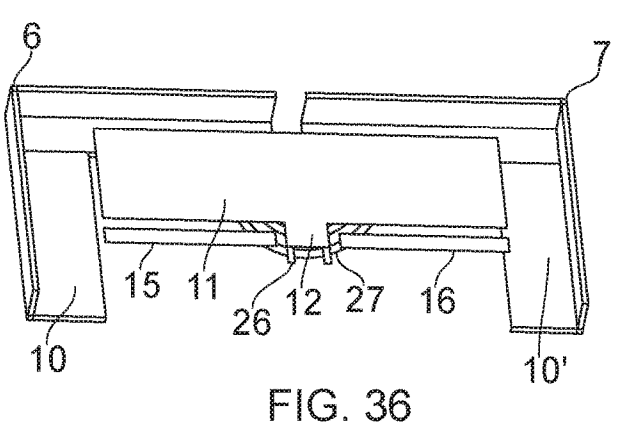
FIG. 36 shows a bottom perspective view of the radiating elements of the embodiment of FIG. 34.
Figure 37:
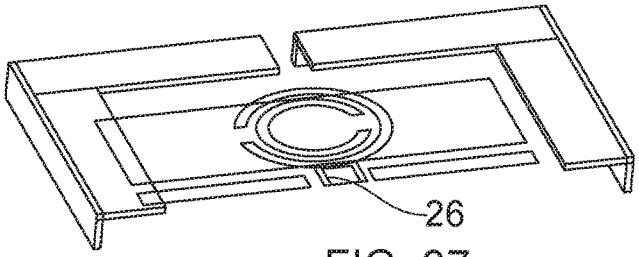
FIG. 37 is a shadow outline showing the position of the first resonator of the embodiment of FIG. 34.

FIG. 33 shows the return loss for all four ports of the embodiment of FIG. 32, with the first port 22 operating at 720 MHz and 1490 MHz, the second port 23 at 720 MHz, the third port 24 at 2500 MHz and 5200 MHz, and the fourth port 25 at 2500 MHz and 5200 MHz.

FIGS. 34 to 38 show a yet further embodiment, with like parts being labelled as for the previous embodiments. The substrate 1 and groundplane 2 are omitted in the Figures for the sake of clarity. In this embodiment, the second and third unbalanced antennas 15, 16 do not have distal ends that are folded downwardly. Instead, the second and third unbalanced antennas 15, 16 have distal ends that are substantially coterminous with the ends of the first unbalanced antenna 11, and do not extend over the distal portions 10, 10' of the balanced antenna 5. Moreover, first and second parasitic resonators 26, 27 are provided on the underside of the substrate (not shown). The first parasitic resonator 26 is a relatively small bracket-shaped element located under and substantially opposite to the central stub 12 of the first unbalanced antenna 11. The second parasitic resonator 27 comprises a pair of relatively large, nested C-shaped elements arranged facing in opposite directions under a central portion of the first unbalanced antenna 11 on the underside of the substrate. The first, smaller parasitic resonator 26 is the right electrical length to provide isolation between the third and fourth ports 24, 25 at 5120 MHz, while the second, larger parasitic resonator 27 is the right electrical length to provide isolation between the third and fourth ports 24, 25 at 2430 MHz.

Figure 38:
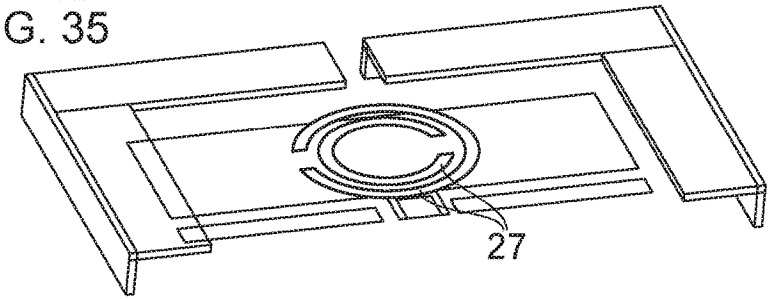
FIG. 38 is a shadow outline showing the position of the second resonator of the embodiment of FIG. 34.
Figure 34:
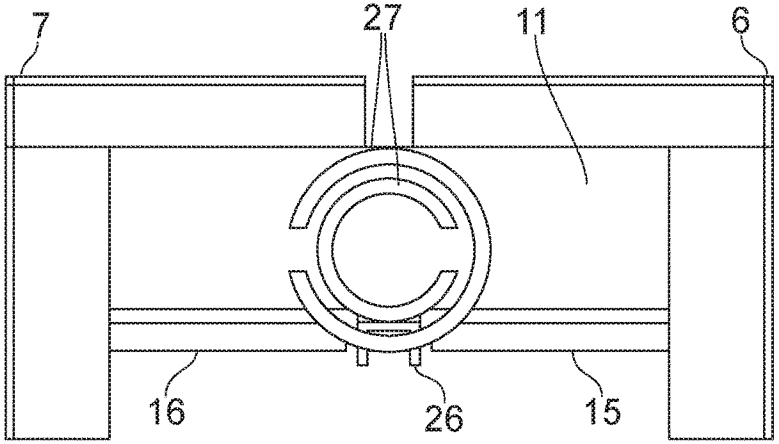
FIG. 34 shows a plan view of the radiating elements of a yet further embodiment.
Figure 35:
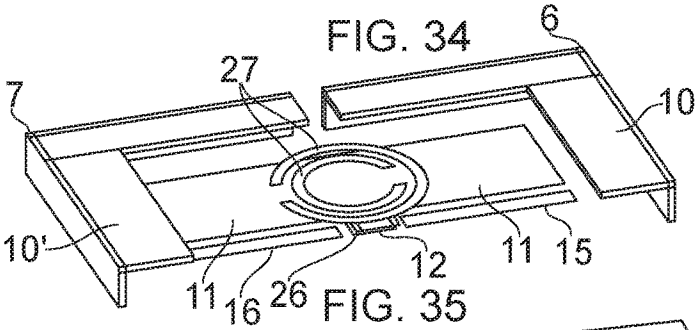
FIG. 35 shows a top perspective view of the radiating elements of the embodiment of FIG. 34.
Figure 39:
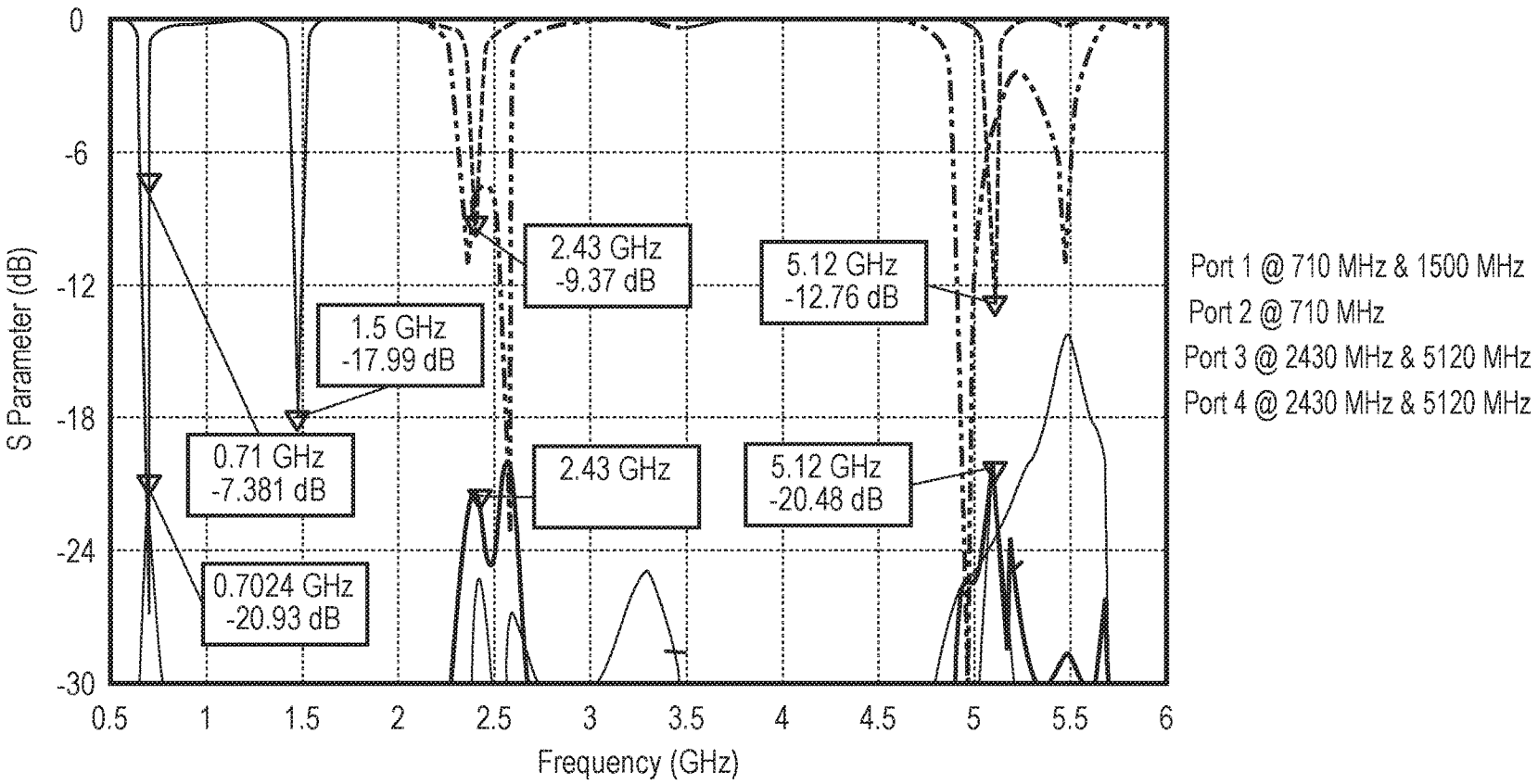
FIG. 39 shows the return loss for the first to fourth ports of the embodiment of FIG. 34 at various frequencies.

FIG. 39 shows the return loss for all four ports of the embodiment of FIG. 38, with the first port 22 operating at 710 MHz and 1500 MHz, the second port 23 at 710 MHz, the third port 24 at 2430 MHz and 5120 MHz, and the fourth port 25 at 2430 MHz and 5120 MHz.

Figure 40:
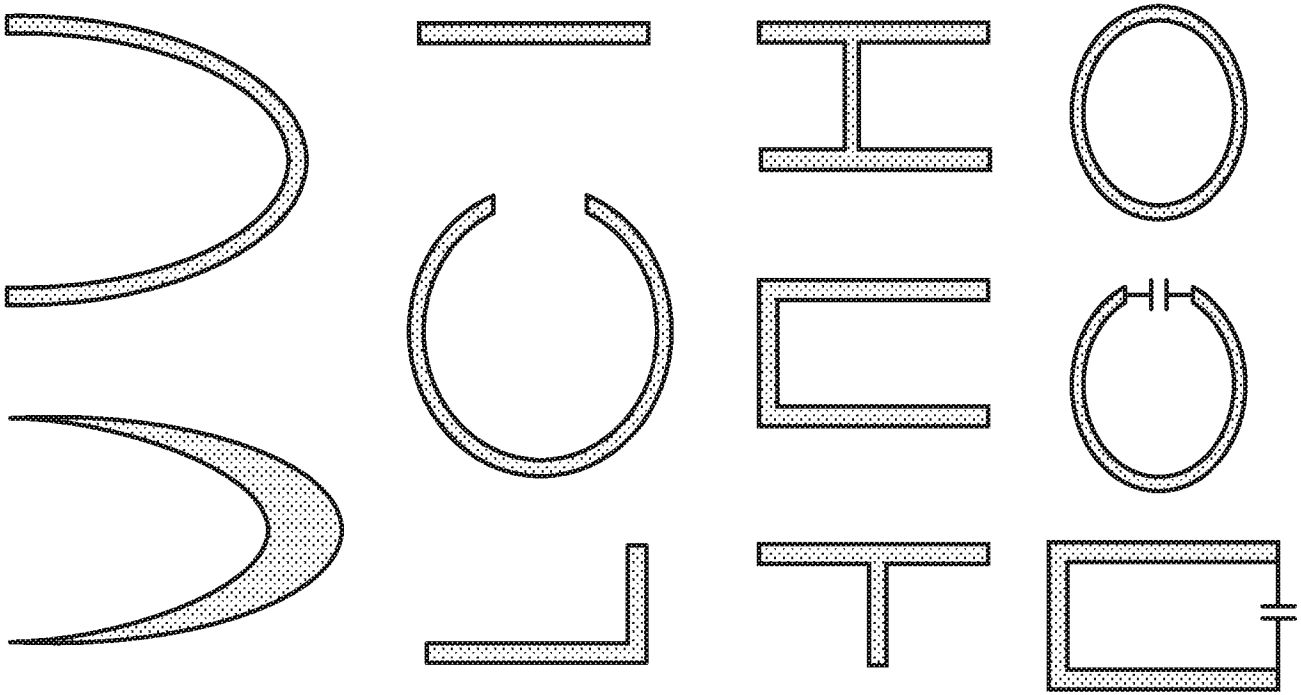
FIG. 40 shows various possible configurations for the resonators.

FIG. 40 shows various different configurations for the parasitic resonators 21, 26, 27, including C-shaped, U-shaped, H-shaped, O-shaped, T-shaped, L-shaped and I-shaped. Certain shapes of parasitic resonator, for example C-shapes and U-shapes, have a mouth portion that may be denoted as a gate, and a capacitor and/or inductor may be placed across the gate.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A reconfigurable antenna device comprising:

a substrate incorporating a first groundplane, a two-arm antenna having first and second arms each having a proximal portion and a distal portion, the proximal portions extending in substantially opposite directions and the distal portions being substantially parallel to each other, a first unbalanced antenna extending across a space between the distal portions and adjacent to the proximal portions of the first and second arms, a second unbalanced antenna located generally adjacent to the first arm and a third unbalanced antenna located generally adjacent to the second arm, the second and third unbalanced antennas respectively extending towards the distal portions of the first and second arms and located between the distal portions, wherein a region at one end of the substrate where the antennas are mounted is free of the first groundplane, the groundplane having an edge facing the end of the substrate where the antennas are mounted, wherein the respective antennas and the first groundplane are substantially coplanar or disposed in two or more substantially parallel planes, wherein each of the two-arm antenna and the first, second and third unbalanced antennas is provided with a respective matching circuit and at least one signal port, wherein the two-arm antenna and the first unbalanced antenna are provided with feedlines located substantially centrally between the distal portions of the first and second arms, and wherein at least the first, second and third unbalanced antennas have feedpoints at a portion of said edge of said first groundplane that is substantially central between the distal portions of the first and second arms.

2. A device as claimed in claim 1, wherein the first and second arms of the two-arm antenna comprise a pair of generally L-shaped members.

3. A device as claimed in claim 2, wherein the L-shaped members are disposed in a substantially mirror-symmetrical arrangement about the longitudinal axis of the substrate.

4. A device as claimed in claim 1, wherein the second arm of the two-arm antenna is configured as a groundplane, and wherein the first arm is configured as an unbalanced antenna.

5. A device as claimed in claim 4, wherein a matching circuit for the unbalanced antenna comprising the first arm is disposed on the second arm.

6. A device as claimed in claim 4, further comprising RF front end circuitry on the second arm.

7. A device as claimed in claim 1, wherein the two-arm antenna is connected to a second groundplane configured as a conductive patch located on the substrate but separated from the first groundplane.

8. A device as claimed in claim 1, wherein the two-arm antenna is configured as a balanced antenna, the first and second arms being configured as a dipole.

9. A device as claimed in claim 1, wherein the first unbalanced antenna comprises an elongate conductive strip as a radiating element.

10. A device as claimed in claim 9, wherein the first unbalanced antenna has a length that is substantially parallel to the proximal portions of the arms of the two-arm antenna.

11. A device as claimed in claim 9, wherein a first half of the conductive strip of the first unbalanced antenna is located generally adjacent and parallel to the proximal portion of the first arm of the two-arm antenna, with a second half being located generally adjacent and parallel to the proximal portion of the second arm.

12. A device as claimed in claim 11, wherein the second unbalanced antenna is located adjacent to and substantially parallel to the first half of the first unbalanced antenna, and thus also generally adjacent to the first arm of the two-arm antenna.

13. A device as claimed in claim 11, wherein the third unbalanced antenna is located adjacent to and substantially parallel to the second half of the first unbalanced antenna, and thus also generally adjacent to the second arm of the two-arm antenna.

14. A device as claimed in claim 1, wherein the first unbalanced antenna further comprises a central stub that extends towards but does not contact the first groundplane.

15. A device as claimed in claim 14, wherein the second unbalanced antenna is located between the distal portion of the first arm of the two-arm antenna and the central stub of the first unbalanced antenna.

16. A device as claimed in claim 14, wherein the third unbalanced antenna is located between the distal portion of the second arm of the two-arm antenna and the central stub of the first unbalanced antenna.

17. A device as claimed in claim 1, wherein the second and third unbalanced antennas each comprise a conductive strip as a radiating element.

18. A device as claimed in claim 1, wherein the two-arm antenna and the first, second and third unbalanced antennas are disposed in the same plane.

19. A device as claimed in claim 1, wherein at least one of the two-arm antenna and the first, second and third unbalanced antennas is mounted in a different plane to the other antennas.

20. A device as claimed in claim 1, wherein the second and third unbalanced antennas are located between the first unbalanced antenna and the edge of the first conductive groundplane facing the end of the substrate where the antennas are mounted.

21. A device as claimed in claim 1, wherein the second and third unbalanced antennas are located between the first unbalanced antenna and, respectively, the proximal portions of the first and second arms of the two-arm antenna.

22. A device as claimed in claim 1, wherein the first, second and third unbalanced antennas are connected to and driven against the first groundplane.

23. A device as claimed in claim 1, wherein at least one of the two-arm antenna and the first, second and third unbalanced antennas is provided with at least two signal ports.

24. A device as claimed in claim 1, wherein the second and third unbalanced antennas are disposed in a plane overlying a plane in which the two-arm antenna is disposed.

25. A device as claimed in claim 24, wherein the distal ends of the second and third unbalanced antennas are folded downwards through substantially 90 degrees towards the distal portions of the two-arm antenna.

26. A device as claimed in claim 1, wherein the second and third unbalanced antennas have respective distal ends that overlap but do not touch the respective distal portions of the first and second arms of the two-arm antenna, wherein the first and second opposed arms are connected together to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, wherein the second unbalanced antenna and the distal portion of the first arm, during operation, electromagnetically couple with each other so as to act as a bandstop filter to reduce propagation of RF signals to the third unbalanced antenna from the second unbalanced antenna, thereby to reduce coupling between the third and fourth signal ports at the given frequency band or bands, and wherein the third unbalanced antenna and the distal portion of the second arm, during operation, electromagnetically couple with each other so as to act as a bandstop filter to reduce propagation of RF signals to the second unbalanced antenna from the third unbalanced antenna, thereby to reduce coupling between the fourth and third signal ports at the given frequency band or bands.

27. A device as claimed in claim 26, wherein the first unbalanced antenna is configured to act as a resonator at the given frequency band or bands, thereby to reduce coupling between the third and fourth signal ports at the given frequency band or bands.

28. A device as claimed in claim 1, further comprising at least one parasitic resonator in the form of a resonant circuit located between the second and third unbalanced antennas.

29. A device as claimed in claim 28, wherein the at least one parasitic resonator is not coplanar with the second and third unbalanced antennas.

30. A device as claimed in claim 28, wherein the at least one parasitic resonator is not coplanar with the first unbalanced antenna.

31. A device as claimed in claim 28, wherein the at least one parasitic resonator extends under or over at least a central portion of the first unbalanced antenna in a substantially parallel plane thereto.

32. A device as claimed in claim 28, wherein the at least one parasitic resonator acts as a bandstop filter at a predetermined frequency band.

33. A device as claimed in claim 28, further comprising a second resonant circuit, configured to resonate in a second frequency band different to the first frequency band, located on the first unbalanced antenna between the first and second arms of the two-arm antenna; thereby to reduce coupling between the third and fourth signal ports in the second frequency band.

34. A reconfigurable antenna device comprising a substrate incorporating a first groundplane, a two-arm antenna having first and second opposed arms each having a proximal portion and a distal portion, the proximal portions extending in substantially opposite directions and the distal portions being substantially parallel to each other, a first unbalanced antenna extending across a space between the distal portions and adjacent to the proximal portions of the first and second arms, a second unbalanced antenna located adjacent to the first arm and a third unbalanced antenna located adjacent to the second arm, the second and third unbalanced antennas respectively extending towards the distal portions of the first and second arms and located between the distal portions, and the second and third unbalanced antennas being located in a plane that is substantially coplanar with or parallel to the substrate, wherein the second and third unbalanced antennas have respective distal ends that overlap but do not touch the respective distal portions of the first and second arms of the two-arm antenna, wherein the first and second opposed arms are both connected to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, wherein the second unbalanced antenna and the distal portion of the first arm, during operation, electromagnetically couple with each other so as to act as a bandstop filter to reduce propagation of RF signals to the third unbalanced antenna from the second unbalanced antenna, thereby to reduce coupling between the third and fourth signal ports at the given frequency band or bands, and wherein the third unbalanced antenna and the distal portion of the second arm, during operation, electromagnetically couple with each other so as to act as a bandstop filter to reduce propagation of RF signals to the second unbalanced antenna from the third unbalanced antenna, thereby to reduce coupling between the fourth and third signal ports at the given frequency band or bands.

35. A device as claimed in claim 34, wherein a region at one end of the substrate where the antennas are mounted is free of the first groundplane, the groundplane having an edge facing the end of the substrate where the antennas are mounted.

36. A reconfigurable antenna device comprising a substrate incorporating a first groundplane, a two-arm antenna having first and second opposed arms each having a proximal portion and a distal portion, the proximal portions extending in substantially opposite directions and the distal portions being substantially parallel to each other, a first unbalanced antenna extending across a space between the distal portions and adjacent to the proximal portions of the first and second arms, a second unbalanced antenna located adjacent to the first arm and a third unbalanced antenna located adjacent to the second arm, the second and third unbalanced antennas respectively extending towards the distal portions of the first and second arms and located between the distal portions, and the second and third unbalanced antennas being located in a plane that is substantially coplanar with or parallel to the substrate, wherein the second and third unbalanced antennas have respective distal ends that are located adjacent to but do not touch the respective distal portions of the first and second arms of the two-arm antenna, wherein the first and second opposed arms are both connected to at least one first signal port, the first unbalanced antenna is connected to at least one second signal port, the second unbalanced antenna is connected to at least one third signal port and the third unbalanced antenna is connected to at least one fourth signal port, wherein the second and third unbalanced antennas and consequently the third and fourth signal ports are configured to operate at substantially the same given frequency band or bands as each other, and wherein a first resonant circuit configured to resonate in a first frequency band is located on the first unbalanced antenna between the first and second arms of the two-arm antenna; thereby to reduce coupling between the third and fourth signal ports in the first frequency band.

* * * * *